US008308154B2

(12) United States Patent
Miyake et al.

(10) Patent No.: US 8,308,154 B2
(45) Date of Patent: Nov. 13, 2012

(54) IMAGE FORMING APPARATUS, IMAGE FORMING SYSTEM, AND CONTROL METHOD THEREFOR

(75) Inventors: Toshiyuki Miyake, Abiko (JP); Manabu Yamauchi, Kashiwa (JP); Naoto Watanabe, Abiko (JP); Takayuki Fujii, Tokyo (JP); Shunsuke Nishimura, Toride (JP); Satoru Yamamoto, Abiko (JP); Yushi Oka, Abiko (JP); Takashi Yokoya, Kashiwa (JP); Hidenori Matsumoto, Kashiwa (JP)

(73) Assignee: Canon Kabushiki Kaisha (JP)

( * ) Notice: Subject to any disclaimer, the term of this patent is extended or adjusted under 35 U.S.C. 154(b) by 723 days.

(21) Appl. No.: 12/391,731

(22) Filed: Feb. 24, 2009

(65) Prior Publication Data

US 2009/0226191 A1 Sep. 10, 2009

(30) Foreign Application Priority Data

Feb. 25, 2008 (JP) ..... 2008-042963
Feb. 24, 2009 (JP) ..... 2009-040373

(51) Int. Cl.
*B65H 39/00* (2006.01)

(52) U.S. Cl. ..... 270/58.17; 270/58.12; 270/58.07; 271/250; 271/252

(58) Field of Classification Search ..... 270/58.17, 270/58.11, 58.07, 58.12, 58.27; 271/226, 271/250, 252, 228
See application file for complete search history.

(56) References Cited

U.S. PATENT DOCUMENTS 4,635,920 A 1/1987 Kodama
5,622,359 A * 4/1997 Kawano et al. ..... 270/58.12
7,559,543 B2 * 7/2009 Moriyama et al. ..... 270/58.12
7,581,725 B2 * 9/2009 Fujita et al. ..... 270/58.17
7,802,782 B2 * 9/2010 Moriyama et al. ..... 270/58.12
7,866,652 B2 * 1/2011 Fujita et al. ..... 270/58.17
7,883,081 B2 * 2/2011 Iguchi et al. ..... 270/58.17
2007/0040328 A1 2/2007 Hattori
2007/0075482 A1 4/2007 Fujita et al.

FOREIGN PATENT DOCUMENTS

CN 1915679 A 2/2007

OTHER PUBLICATIONS

Notification of the First Office Action issued in corresponding Chinese Patent Application No. 200910004466.8 dated Nov. 9, 2010. Full English abstract provided.

* cited by examiner

*Primary Examiner* — Kaitlin Joerger
(74) *Attorney, Agent, or Firm* — Rossi, Kimms & McDowell LLP

(57) ABSTRACT

A control method for an image forming system capable of preventing reduction of the ability of the system even if a shift transportation function becomes an abnormal condition. An image forming apparatus forms an image on a sheet. A first sheet process apparatus has a first moving unit receiving the sheet on which the image is formed and moving the sheet in a width direction. In a determination step, it is determined whether a second sheet process apparatus having a second moving unit moving the sheet in the width direction is connected to an upstream side of the first sheet process apparatus. In a detection step, it is detected an abnormal condition of the first moving unit. In a sheet movement step, the second moving unit moves the sheet in the width direction if an abnormal condition is detected and the second sheet process apparatus is connected.

10 Claims, 18 Drawing Sheets

IMAGE FORMING APPARATUS, IMAGE FORMING SYSTEM, AND CONTROL METHOD THEREFOR

BACKGROUND OF THE INVENTION

1. Field of the Invention

The present invention relates to an image forming apparatus such as a printer or a copier, an image forming system equipped with such an image forming apparatus and a plurality of sheet processing apparatuses, and a control method for such a system.

2. Description of the Related Art

In recent years, there has been practically used a sheet processing apparatus that divides a plurality of image formed sheets ejected from an image forming apparatus (a printer or a copier) into groups, sorts and stacks them on a stacking tray so that positions of the sheets (or sheaves of sheets) of the respective groups are displaced in a width direction. In this case, the width direction refers to the direction perpendicular to the transportation direction on the in-plane of the sheet.

A conventional sheet processing apparatus with the aforementioned sorting function is provided with a processing tray at the front stage of the stacking tray, moves the sheet in the width direction on the processing tray and then moves the sheet to an elevating stacking tray to stack it thereon. A place where the processing tray is arranged, however, is limited to a position at the very front of the stacking tray, so that if the transportation path for the sheet is plural branched, the processing tray needs to be arranged on every branch.

For that reason, there has been proposed a mechanism in which a pair of rollers arranged on the transportation path for the sheet is moved in the width direction with the sheet sandwiched therebetween to displace the transportation position in the width direction of the sheet (refer to U.S. Pat. No. 4,635,920, for example). The sheet processing apparatus disclosed in the patent publication is incorporated into the image forming apparatus and a pair of ejecting rollers is moved in the axial direction to eject the sheet onto the stacking tray, ejecting and stacking the sheet. The sheet ejected onto the stacking tray through an image forming process and a fixing process is moved in the axial direction at two stages with the sheet sandwiched between the pair of ejecting rollers, thereby the sheet is sorted and stacked with a stack position displaced in the width direction on the stacking tray.

In addition, there has been proposed a sheet processing apparatus adapted to achieve high productivity (refer to a publication of the US Patent Application No. 2007/0075482, for example). The sheet processing apparatus disclosed in the patent publication transports the sheet while shifting the sheet in the width direction to a predetermined position by means of a shift transport mechanism located on the upstream side of a sheet stacking unit in the direction in which the sheet is transported. The sheet processing apparatus stacks the sheet on the processing tray with shift and previously moves a pair of aligning boards that aligns the sheet in the width direction on the processing tray to a position in response to the predetermined position of the sheet.

When an abnormal condition (error) occurs at the shift transport mechanism, the sheet processing apparatus disclosed in the publication of the US Patent Application No. 2007/0075482 nullifies the shift function of the shift transport mechanism and increases the distance between the pair of aligning boards. The increase of the distance between the aligning boards precludes the sheet from colliding with the pair of aligning boards even if the sheet is transported to the aligning boards with the sheet misaligned in the width direction.

However, since the increase of the distance between the aligning boards takes a longer time to return to a standby position after the aligning operation, a sheet feeding interval increases. This reduces the number of sheets to be processed in unit time.

In a print-on-demand (POD) system, a plurality of sheet processing apparatuses with shift transportation functions may be connected.

As described above, if an abnormal condition occurs at the shift transport mechanism in the sheet processing apparatus, the use of many functions is uniformly restricted, which lowers the ability of the system.

Further, even if the plurality of sheet processing apparatuses with shift transportation functions are connected, there is not used the shift transportation function of the sheet processing apparatus that is not designated. Accordingly, it is desirable to effectively use the shift transportation function.

SUMMARY OF THE INVENTION

The present invention provides a control method for an image forming system, an image forming system and an image forming apparatus which are capable of preventing reduction of the ability of the system even if a shift transportation function becomes an abnormal condition and of using the shift transportation function effectively.

Accordingly, the present invention provides a control method for an image forming system including an image forming apparatus forming an image on a sheet and a first sheet process apparatus having a first moving unit that receives the sheet on which the image is formed by the image forming apparatus and moves the position of the sheet in a width direction orthogonal to the direction in which the sheet is transported, the control method comprising a determination step for determining whether a second sheet process apparatus having a second moving unit which moves the position of the sheet in the width direction is connected to a side further upstream than the first sheet process apparatus, a detection step for detecting whether the first moving unit encounters an abnormal condition, and a sheet movement step for causing the second moving unit to change the position of the sheet in the width direction while the sheet is transported along the second sheet process apparatus if an abnormal condition is detected in the detection step and it is determined that the second sheet process apparatus is connected in the determination step.

Accordingly, the present invention provides a control method for an image forming system including an image forming apparatus that forms an image on a sheet, a first sheet process apparatus having a first moving unit that moves the position of the sheet in a width direction orthogonal to the direction in which the sheet is transported, a first stack unit that stacks the sheet moved in the width direction by the first moving unit and a first aligning unit that aligns the sheet stacked on the first stack unit in the width direction, and a second sheet process apparatus, which is connected to a side further upstream than said first sheet process apparatus, having a second moving unit that receives the sheet ejected from the image forming apparatus and moves the position of the sheet in the width direction orthogonal to the direction in which the sheet is transported, a second stack unit that stacks the sheet moved in the width direction by the second moving unit and a second aligning unit that aligns the sheet stacked on the second stack unit in the width direction, the control method comprising a determination step for determining where to stack the sheet ejected from the image forming apparatus, a detection step for detecting an abnormal condition of the first moving unit, and a sheet movement step for causing the second moving unit to change the position of the sheet in the width direction while the sheet is transported along the second sheet process apparatus if it is determined that the sheet is stacked on the first stack unit and an abnormal condition is detected in the detection step.

Accordingly, the present invention provides an image forming system capable of transferring a sheet ejected from an image forming apparatus to a plurality of sheet process apparatus, the image forming system comprising a first sheet process apparatus that includes a first moving unit that moves the position of the sheet in a width direction orthogonal to the direction in which the sheet is transported and a stack unit on which the sheet processed by the first moving unit is stacked, a second sheet process apparatus that is connected to the upstream side of the first sheet process apparatus and includes a second moving unit that moves the position of the sheet in a width direction orthogonal to the direction in which the sheet is transported and a detection unit that detects an abnormal condition, and a control unit that performs control to cause the second moving unit to change the position of the sheet in the width direction and transport the sheet to the first sheet process apparatus if the detection unit detects an abnormal condition in the first moving unit when the sheet ejected from the image forming apparatus is transported to the first sheet process apparatus through the second sheet process apparatus and stacked with the position thereof being changed in the width direction.

Accordingly, the present invention provides an image forming apparatus connected to a first sheet process apparatus having a first moving unit which moves a position of a sheet in a width direction orthogonal to the direction in which the sheet is transported and a second sheet process apparatus which is arranged further upstream than the first sheet process apparatus and has a second moving unit that moves the position of the sheet in the width direction and a stack unit on which the sheet processed by the moving unit is stacked, the image forming apparatus comprising an image forming unit for forming an image on a sheet, a detection unit for detecting an abnormal condition of the first moving unit, and a control unit that instructs the second sheet process apparatus to cause the second moving unit to move the sheet in the width direction if the detection unit detects an abnormal condition when the sheet is transported to the first sheet process apparatus and stacked on the stack unit with the position of the sheet being changed in the width direction.

Accordingly, the present invention provides an image forming apparatus connected to a first sheet process apparatus having a first moving unit that moves a position of a sheet in a width direction orthogonal to the direction in which the sheet is transported and a first stack unit on which the sheet processed by the first moving unit is stacked and a second sheet process apparatus which is arranged further upstream than first sheet process apparatus and has a second moving unit that moves the position of the sheet in the width direction and a second stack unit on which the sheet processed by the second moving unit is stacked, the image forming apparatus comprising an image forming unit for forming an image on a sheet, and a control unit that instructs the second sheet process apparatus to cause the second moving unit to move the sheet in the width direction irrespective that the sheet is stacked on any of the first and the second stack unit.

According to the present invention, the shift transportation function of the first sheet processing apparatus modifies the position of a sheet in its width direction if the shift transportation function of the second sheet processing apparatus connected to the downstream side of the first sheet processing apparatus encounters an abnormal condition. This enables the system to keep the ability of the system and to use the shift transportation function effectively.

The features and advantages of the invention will become more apparent from the following detailed description taken in conjunction with the accompanying drawings.

DESCRIPTION OF THE PREFERRED EMBODIMENTS

The embodiments of the present invention will be hereinafter described in detail with reference to the figures.

First Embodiment

General Configuration of Image Forming System

Figure 1:
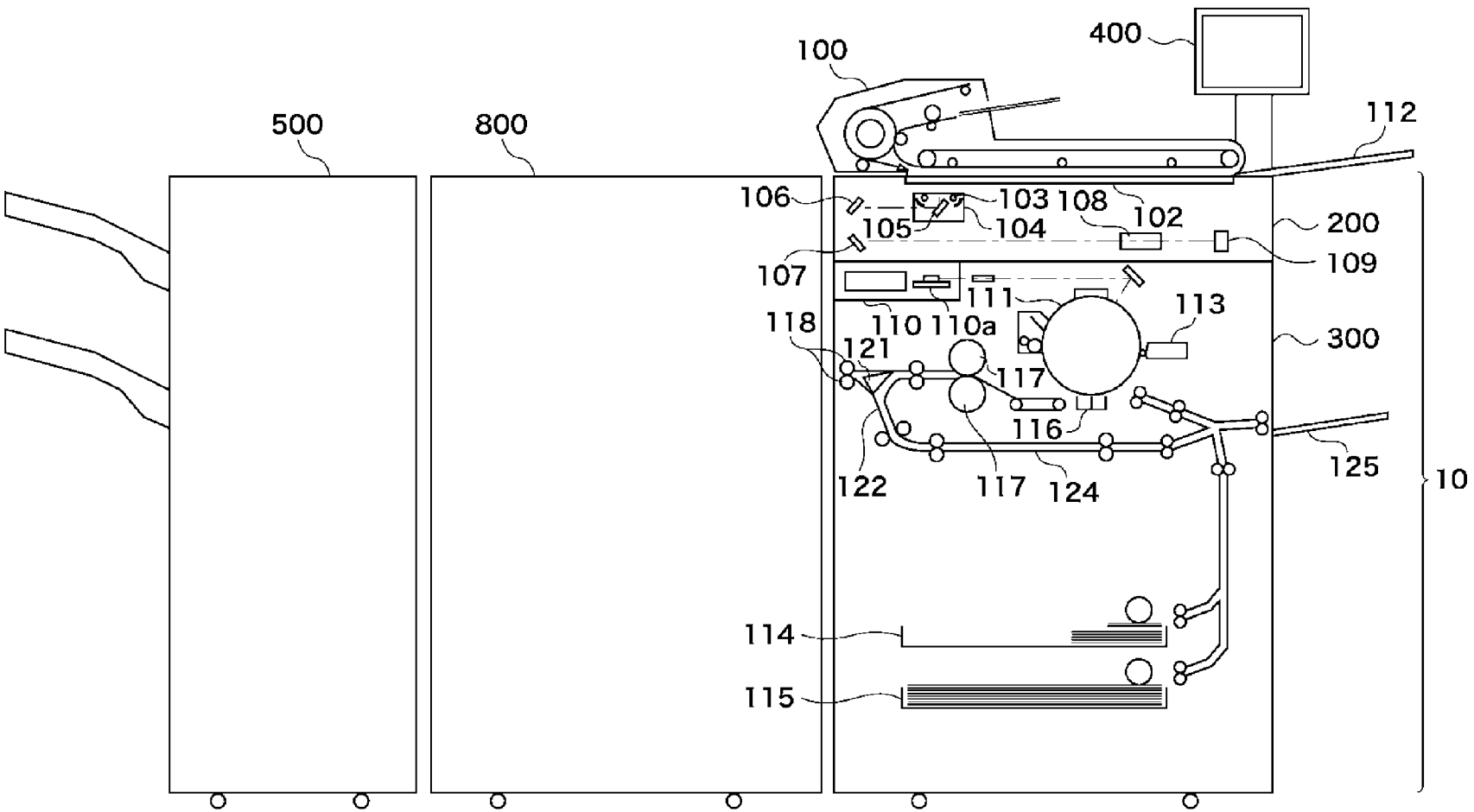
FIG. 1 is a schematic diagram illustrating the general mechanical configuration of an image forming system according to an embodiment of the present invention.

FIG. 1 is a schematic diagram illustrating the general mechanical configuration of an image forming system according to the embodiment of the present invention.

In FIG. 1, the image forming system includes an image forming apparatus 10 adapted to form an image on a sheet to which a document feeder 100 adapted to feed a document is attached, and a plurality of sheet processing apparatuses 800 and 500 connected to the image forming apparatus 10. In this embodiment, a stacker 800 as an upstream sheet processing apparatus (a second sheet processing apparatus) and a finisher 500 as a downstream sheet processing apparatus (a first sheet processing apparatus) arranged in the sheet transportation direction are connected to the image forming apparatus 10. The image forming apparatus 10 includes an image reader 200 to read an image on a document, and a printer 300 to form the image on a sheet.

The document feeder 100 is mounted over the image reader 200 of the image forming apparatus 10 and feeds the document, which is set on the document tray with its reading surface being upward, in the left direction in FIG. 1 in the order from the first page one after another. The document feeder 100 transports the document through a curved path onto a platen glass 102 and moves it from left to right in FIG. 1 through a position where a moving document is read and ejects it to a paper ejecting tray 112. An operation display 400 is installed over the image reader 200 of the image forming apparatus 10.

In the image reader 200 of the image forming apparatus 10, a scanner unit 104 moves to a reading position where a moving document is read to read the document when the document is passing the reading position on the platen glass 102 from left to right (reading a moving document). Specifically, when the document is passing the position where a moving document is read, the reading surface of the document is irradiated with light of a lamp 103 in the scanner unit 104 and the light reflected from the document is led to a lens 108 through mirrors 105, 106 and 107. The light passing through the lens 108 is imaged on the image pickup surface of an image sensor 109.

In the reading of the moving document, while the image sensor 109 reads linear images of the document in the principal scanning direction (that is, the direction orthogonal to the transportation direction of the document) line by line when the document is passing the reading position, the document is transported in the auxiliary scanning direction (that is, the transportation direction), thereby the entire image of the document is read. The images of the document optically read by the image sensor 109 are converted to image data and outputted. The image data outputted from the image sensor 109 is processed by an image signal controller 202 described below and then outputted as a video signal to an exposure control unit 110 of the printer 300.

The document is transported onto the platen glass 102 and stopped at a predetermined position by the document feeder 100 and, in this state, the scanner unit 104 may scan from left to right direction in the figure to read the document (reading a fixed document).

When the document is read without using the document feeder 100, a user lifts the document feeder 100, places the document on the platen glass 102 and then causes the scanner unit 104 to scan from left to right in FIG. 1 to read the document. That is, when the document is read without using the document feeder 100, the document is fixed and read.

The exposure control unit 110 of the printer 300 in the image forming apparatus 10 emits a laser beam modulated based on a video signal inputted from the image reader 200. The laser beam is scanned by a polygon mirror 110*a* to irradiate a photoconductive drum 111. An electrostatic latent image according to the scanned laser beam is formed on the photoconductive drum 111. Incidentally, the exposure control unit 110 modulates a laser beam so that a correct image (which is not a mirror image) is formed when a fixed document is read.

The electrostatic latent image on the photoconductive drum 111 is visualized as a developer image by a developer supplied from a developing unit 113. On the other hand, a sheet (paper) is supplied from one of cassettes 114 and 115, a manual paper feeder 125 and a double-face transportation path 124 and is transported to a space between the photoconductive drum 111 and a transfer unit 116 at the timing synchronized with the start of irradiation of the laser beam. The developer image formed on the photoconductive drum 111 is transferred on the sheet by the transfer unit 116.

The sheet on which the developer image is transferred is transported to a fixing unit 117. The fixing unit 117 heats and presses the sheet to fix the developer image on the sheet. The sheet passing the fixing unit 117 is ejected through a flapper 121 and an ejecting roller 118 from the printer 300 to the external units (the stacker 800 and the finisher 500) of the image forming apparatus.

The process when the sheet is ejected so that its image formation surface points downward (face down) is described hereinafter. The sheet passing the fixing unit 117 is temporarily led into an inversion path 122 by the switching operation of the flapper 121, switched back after the rear end of the sheet passed the flapper 121 and ejected through the ejecting roller 118. This ejection pattern is referred to as an inverse ejection. The inverse ejection is used when images are sequentially formed in the order from the top page, for example, when images of a document read by the document feeder 100 are formed or when images transmitted from a computer are formed, so that the order of the ejected sheets coincides with a correct order of pages.

The process when a hard sheet such as OHP sheet is supplied from the manual paper feeder 125 and an image is formed thereon is described hereinafter. The sheet is ejected by the ejecting roller 118 so that its image formation surface points upward (face up) without being led to the inversion path 122.

In addition, the duplexing process for forming images on both surfaces of the sheet is described hereinafter. The sheet is led to the inversion path 122 by the switching operation of the flapper 121 and then transported to the duplexing transportation path 124 and supplied again to a space between the photoconductive drum 111 and the transfer unit 116 at the timing described above. Thereby, an image is formed also on the other side of the sheet to which the image has been formed on the one surface.

The sheet ejected from the printer 300 of the image forming apparatus 10 is sent to the stacker 800 and the finisher 500. The stacker 800 performs an offset stack process. The finisher 500 performs the offset stack process and a binding process. The offset stack process is described later.

[Configuration of Controller of Image Forming Apparatus]

Figure 2:
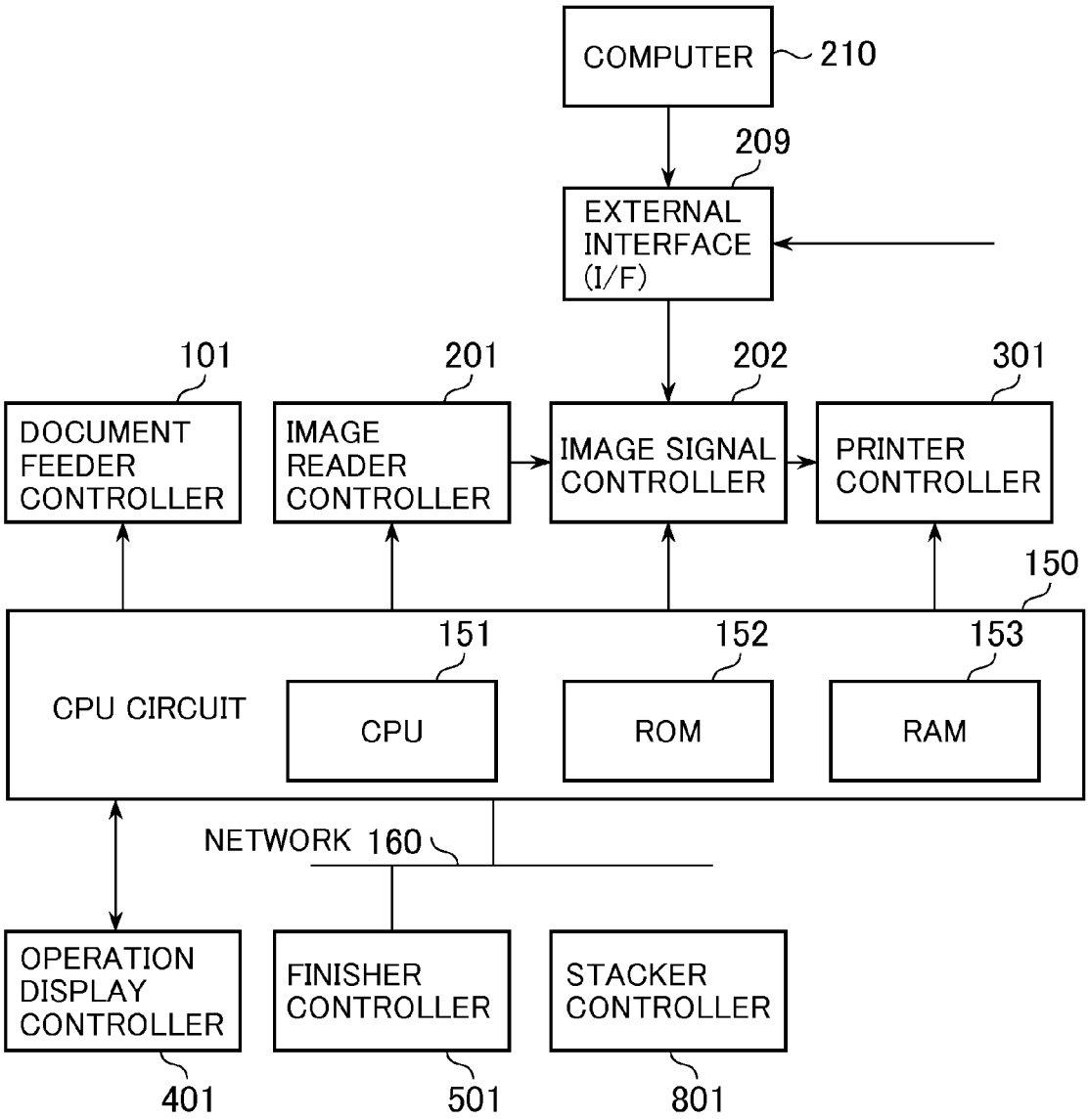
FIG. 2 is a block diagram illustrating an electrical configuration mainly focused on the controller of the image forming apparatus in FIG. 1.

FIG. 2 is a block diagram illustrating an electrical configuration mainly focused on the controller of the image forming apparatus 10.

In FIG. 2, the controller entirely controls the image forming system and includes a CPU circuit 150 (control unit). The CPU circuit 150 includes a CPU 151, a ROM 152 and a RAM 153. The CPU circuit 150 communicates with a document feeder controller 101, an image reader controller 201, an image signal controller 202, an external interface (I/F) 209, a printer controller 301 and an operation display controller 401 to have control over the controllers in accordance with a control program.

The CPU circuit 150 controls a finisher controller 501 of the finisher 500 and a stacker controller 801 of the stacker 800 through a network 160. The ROM 152 stores the control program executed by the CPU circuit 150. The RAM 153 is used as a storage area for temporarily holding control data and a work area for arithmetic processing related to the control of the CPU circuit 150.

The document feeder controller 101 drives and controls the document feeder 100 in accordance with an instruction from the CPU circuit 150. The image reader controller 201 drives and controls the scanner unit 104 and the image sensor 109 and transfers an analog image signal outputted from the image sensor 109 to the image signal controller 202.

The image signal controller 202 converts the analog image signal to a digital image signal, then applies various processes to the digital image signal, converts it to a video signal, and outputs it to the printer controller 301. The image signal controller 202 also applies various processes to a digital signal inputted from a computer 210 through an external I/F 209, converts it to a video signal, and outputs it to the printer controller 301.

The printer controller 301 drives the exposure control unit 110 according to the video signal inputted from the image signal controller 202.

An operation display controller 401 transfers information between the operation display 400 (refer to FIG. 3) and the CPU circuit 150. The operation display controller 401 not only outputs key signals corresponding to key operations of the operation display 400 to the CPU circuit 150 but also displays corresponding information to the display in accordance with a signal from the CPU circuit 150.

The stacker controller 801 is mounted on the stacker 800 and transfers information to and from the CPU circuit 150 to drive and control the whole stacker. What is controlled is described later. The finisher controller 501 is mounted on the finisher 500 and transfers information to and from the CPU circuit 150 to drive and control the whole finisher. What is controlled is described later.

[Configuration of Operation Display of Image Forming Apparatus]

Figure 3:
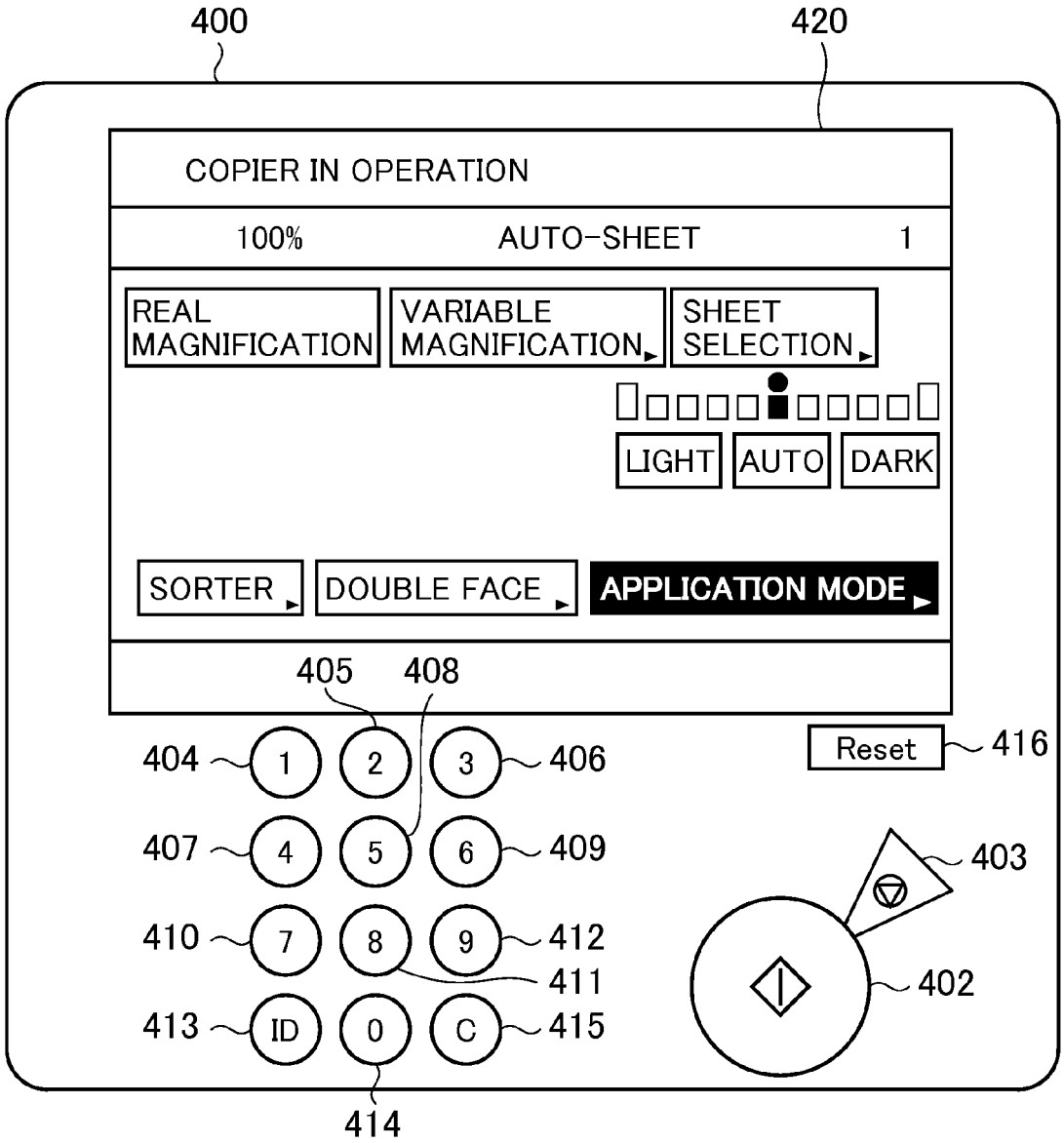
FIG. 3 shows a layout of the operation display of the image forming apparatus in FIG. 1.

FIG. 3 shows a layout of the operation display 400 of the image forming apparatus 10.

In FIG. 3, the operation display 400 includes a liquid crystal display 420 having a touch panel on which soft keys can be formed over a screen, and various keys 402 to 416. A start key 402 is depressed when an image formation operation is started. A stop key 403 is depressed when the image formation operation is interrupted. Ten keys 404 to 412 and 414 are depressed when numerals are inputted. An ID key 413 is depressed when ID is set. A clear key 415 is depressed when setting is erased. A reset key 416 is depressed when the current state is returned to the initial state.

As a following process mode, the image forming apparatus 10 has a non-sorting mode, a sorting mode, a shift sorting mode, a staple sorting mode (a binding mode), a bookbinding mode and switching of sheet ejection place (between stacker 800/finisher 500). When a user sets the following process mode, the user selects the soft key "sorter" on the initial screen of the liquid crystal display 420 to display a menu selection screen, and sets the following process mode using the menu selection screen.

[Configuration of Stacker]

Figure 4:
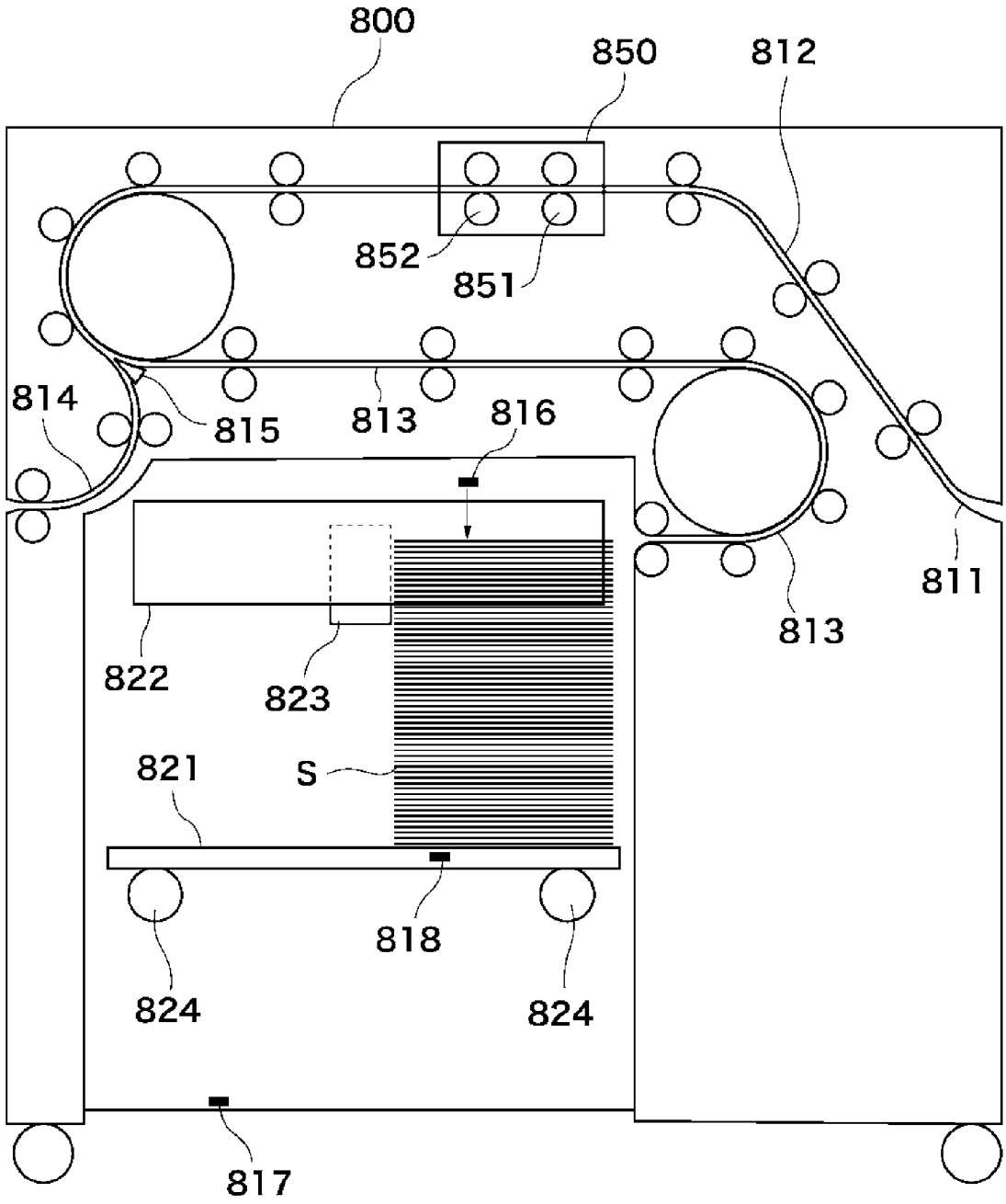
FIG. 4 is a schematic diagram illustrating a mechanical configuration of the stacker in FIG. 1.

FIG. 4 is a schematic diagram illustrating a mechanical configuration of the stacker 800.

In FIG. 4, the stacker 800 includes transportation paths 812 to 814, a stack tray 821 (stack unit), sheet regulating members 822 and 823 and a horizontal registration correcting unit 850. The stack tray 821 is moved up and down by a motor (not shown), sequentially stacks the sheets S that are ejected from the image forming apparatus 10 after applying the prescribed processes and is capable of stacking a large number of the sheets S.

The sheet regulating members 822 and 823 are disposed to improve a stack efficiency of the sheet on the stack tray 821. The sheet regulating member 822 is driven by a motor (not shown) and regulates a position of a sheet in the sheet-width direction (that is, the direction orthogonal to the sheet-transportation direction, and the direction orthogonal to the paper surface in FIG. 4). The sheet regulating member 823 is driven by a motor (not shown) and regulates a position of a sheet in the sheet-transportation direction (that is, the direction in which the sheet is ejected to the stack tray 821 or the right and left direction in FIG. 4).

The sheet ejected from the image forming apparatus 10 is drawn into the stacker through a sheet inlet portion 811 of the stacker 800. The drawn sheet is transported through the transportation path 812, and transported to the stack tray 821 through the transportation path 813 or transported to the finisher 500 through the transportation path 814. The horizontal registration correcting unit 850 is disposed midway along the transportation path 812. A plurality of transportation rollers is provided along the transportation paths 812 to 814.

The horizontal registration correcting unit 850 applies the following operation to all sheets to be ejected in the shift sorting mode in which the sheet is ejected to the stack tray 821 so that the sheet is shifted (offset) in the width direction (the direction orthogonal to the sheet-transportation direction). In other words, the horizontal registration correcting unit 850 not only corrects the deviation of horizontal registration of the sheet (amount by which the sheet deviates in the width direction from the center of the transportation path) but also transports the sheet while shifting the sheet to a predetermined position in the width direction. The horizontal registration correcting unit 850 is provided with transportation rollers 851 and 852 and described in detail later with reference to FIG. 7A.

The transportation path 813 is used for stacking the sheet ejected from the image forming apparatus 10 onto the stack tray 821. The transportation path 814 is used for ejecting the sheet from the image forming apparatus 10 to the finisher 500 being the sheet processing apparatus on the downstream side instead of stacking the sheet on the stack tray 821.

A switching flapper 815 switches the transportation path for the sheet to any one of the transportation path 813 and the transportation path 814. A paper surface detecting sensor 816 detects the top surface of sheaf of sheets stacked on the stack tray 821 and is used to keep the stack tray 821 in a sheet receiving position by a motor (not shown) when the sheets are sequentially stacked on the stack tray 821. A stack-tray-lower-limit detecting sensor 817 is used when the stack tray 821 is moved down to a sheet outlet position, as described later. A sheet detecting sensor 818 detects whether the sheet is stacked on the stack tray 821.

When the sheet is ejected from the image forming apparatus 10, the CPU circuit 150 of the controller of the image forming apparatus 10 transmits a sheet width information indicating the width of the sheet ejected to the stacker 800 to the stacker controller 801. The stacker controller 801 controls the sheet regulating members 822 and 823 so as to coincide with the sheet width in accordance with the sheet width information. This enables the sheets to be stacked on the stack tray 821 in proper alignment.

When the sheets stacked on the stack tray 821 are taken out; the stack tray 821 is moved by a motor (not shown) to the sheet outlet position. The stack tray 821 is provided with casters 824. When the stack tray 821 is taken out, the stack tray 821 is moved down until the stack-tray-lower-limit detecting sensor 817 detects the lower limit position of the stack tray 821, and then the downward movement of the stack tray 821 is stopped. This enables the stack tray 821 to be taken out.

[Configuration of Finisher]

Figure 5:
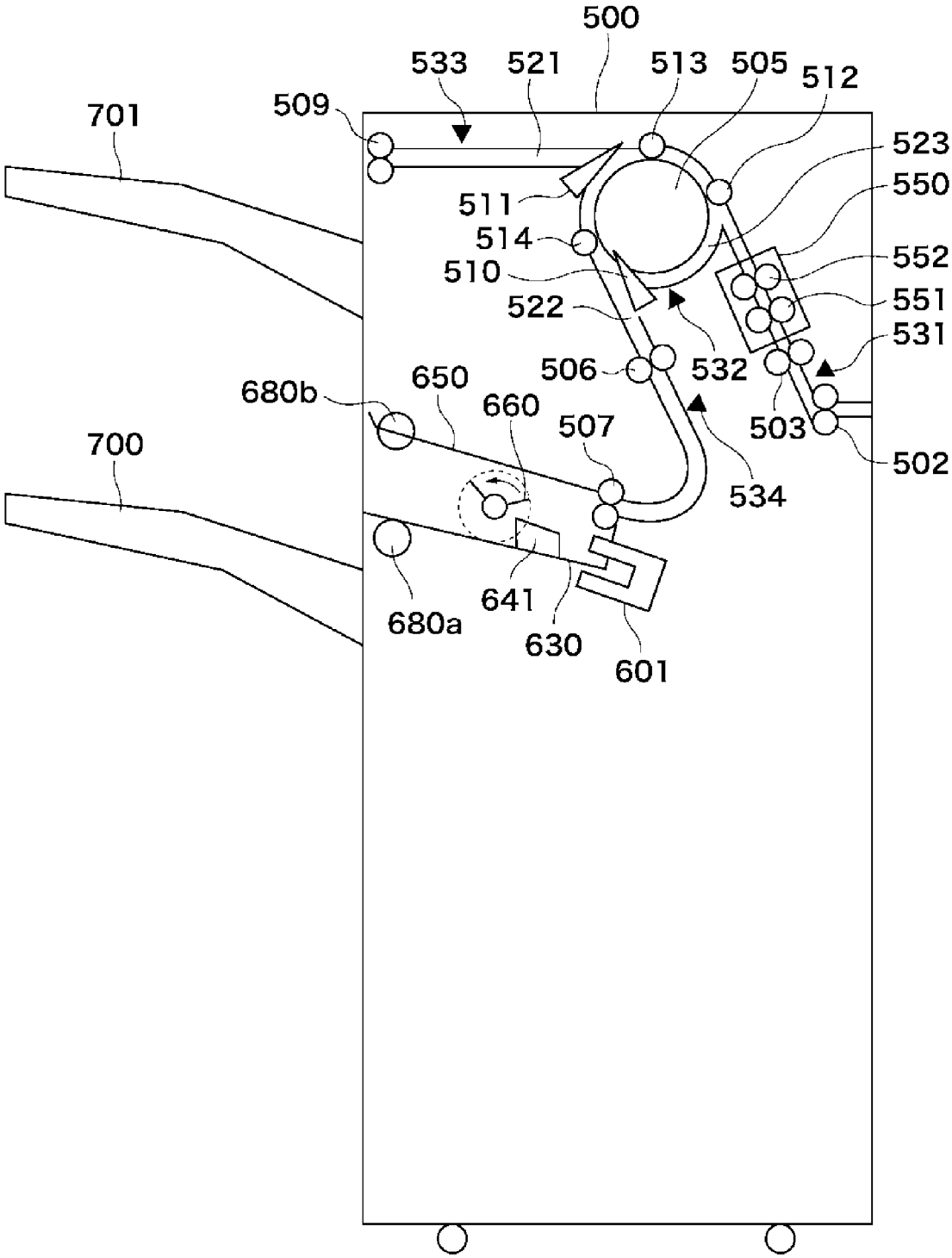
FIG. 5 is a schematic diagram illustrating a mechanical configuration of the finisher in FIG. 1.

FIG. 5 is a schematic diagram illustrating a mechanical configuration of the finisher 500.

In FIG. 5, the finisher 500 includes a buffer roller 505, transportation paths 521 and 522, a horizontal registration correcting unit 550, a process tray 630, stack trays 700 and 701 (stack unit). The finisher 500 sequentially receives the sheet ejected from the image forming apparatus 10 and transported through the stacker 800 and performs various processes such as a non-sorting process, a shift sorting process, a binding process and a staple sorting process.

The non-sorting process ejects sheets without sorting. The shift sorting process ejects sheets so as to shift them in the width direction. The binding process arranges the received sheets and binds them into one sheaf. The staple sorting process staples the rear end of the sheaf.

The finisher 500 introduces the sheet ejected from the image forming apparatus 10 through the stacker 800 by a pair of inlet rollers 502. The sheet introduced inside by the pair of inlet rollers 502 is sent to the buffer roller 505 through a pair of transportation rollers 503. An inlet sensor 531 for detecting the sheet is provided midway between the pair of inlet rollers 502 and the pair of transportation rollers 503 on the transportation path. In addition, the horizontal registration correcting unit 550 is provided midway between the pair of transportation rollers 503 and the buffer roller 505 on the transportation path.

The horizontal registration correcting unit 550 applies the following operation to all sheets introduced into the finisher 500 in the shift sorting mode in which the sheets are ejected to any of the stack trays 700 and 701 so as to offset. In other words, the horizontal registration correcting unit 550 not only corrects the horizontal registration of the sheet but also transports the sheet while shifting the sheet to a predetermined position in the width direction. The horizontal registration correcting unit 550 is provided with transportation rollers 551 and 552, which are described in detail later with reference to FIG. 7B.

On the downstream side of the horizontal registration correcting unit 550, there is provided the buffer roller 505 around which several sheets, which are transported through the pair of transportation rollers 503 and the horizontal registration correcting unit 550, can be wound. The sheets are wound around the buffer roller 505 by means of depressing rollers 512, 513 and 514 while the buffer roller 505 rotates and are transported in the rotating direction of the buffer roller 505. A switching flapper 511 is provided between the depressing rollers 513 and 514. A switching flapper 510 is provided on the downstream side of the depressing roller 514.

The switching flapper 511 removes the sheets wound around the buffer roller 505 from the buffer roller 505 and conducts them to the transportation path 521 or 522. The switching flapper 510 removes the sheets wound around the buffer roller 505 to conduct them to the transportation path 522 or conducts the sheets wound around the buffer roller 505 to a buffer path 523 without removing the sheets.

When the sheet wound around the buffer roller 505 is conducted to the transportation path 521, the switching flapper 511 acts to remove the wound sheet from the buffer roller 505 and conducts it to the transportation path 521. The sheet conducted to the transportation path 521 is ejected to the stack tray 701 on the upper stage side through a pair of ejecting rollers 509. A paper ejecting sensor 533 for detecting the sheet is provided midway along the transportation path 521.

When the sheet wound around the buffer roller 505 is conducted to the buffer path 523, neither the switching flapper 510 nor the switching flapper 511 acts and the sheet is sent to the buffer path 523 with being wound round the buffer roller 505. A buffer path sensor 532 for detecting the sheet is provided midway along the transportation path of the buffer path 523.

When the sheet wound around the buffer roller 505 is conducted to the transportation path 522, the switching flapper 511 does not act, but the switching flapper 510 acts to remove the wound sheet from the buffer roller 505 and conducts it to the transportation path 522.

The sheet conducted to the transportation path 522 is stacked on the process tray 630 through pairs of transportation rollers 506 and 507. Aligning members 641 are provided on both sides (on the front and back sides of the paper surface in FIG. 5) in the width direction of the process tray 630. The sheaf of a plurality of sheets stacked on the process tray 630 is subjected to an aligning process by the aligning member 641 or a stapling process by a stapler 601 as required.

The aligning member 641 is composed of a pair of aligning members 641*a* and 641*b* (refer to FIG. 15) and aligns the sheet on the process tray 630. The stapler 601 can be moved along the periphery of the process tray 630. The stapler 601 is capable of stapling the sheaf of sheets stacked on the process tray 630 in the rearmost position (rear end) of the sheaf of sheets with respect to the sheet transportation direction (in the left direction of FIG. 5). Incidentally, a paddle 660 provided on the process tray 630 is an assisting member to assist the movement of the sheet.

The sheet subjected to a prescribed process on the process tray 630 is ejected to the stack tray 700 on the lower stage side by ejecting rollers 680*a* and 680*b*. The ejecting roller 680*b* is supported by a swinging guide 650. The swinging guide 650 swings the ejecting roller 680*b* by a swinging motor (not shown) so that the ejecting roller 680*b* abuts on the sheet on the topmost portion of the process tray 630. When the ejecting roller 680*b* abuts on the sheet on the topmost portion of the process tray 630, the ejecting roller 680*b* can e eject the sheaf of sheets on the process tray 630 to the stack tray 700 in concert with the ejecting roller 680*a*.

[Configuration of Stacker Controller]

Figure 6:
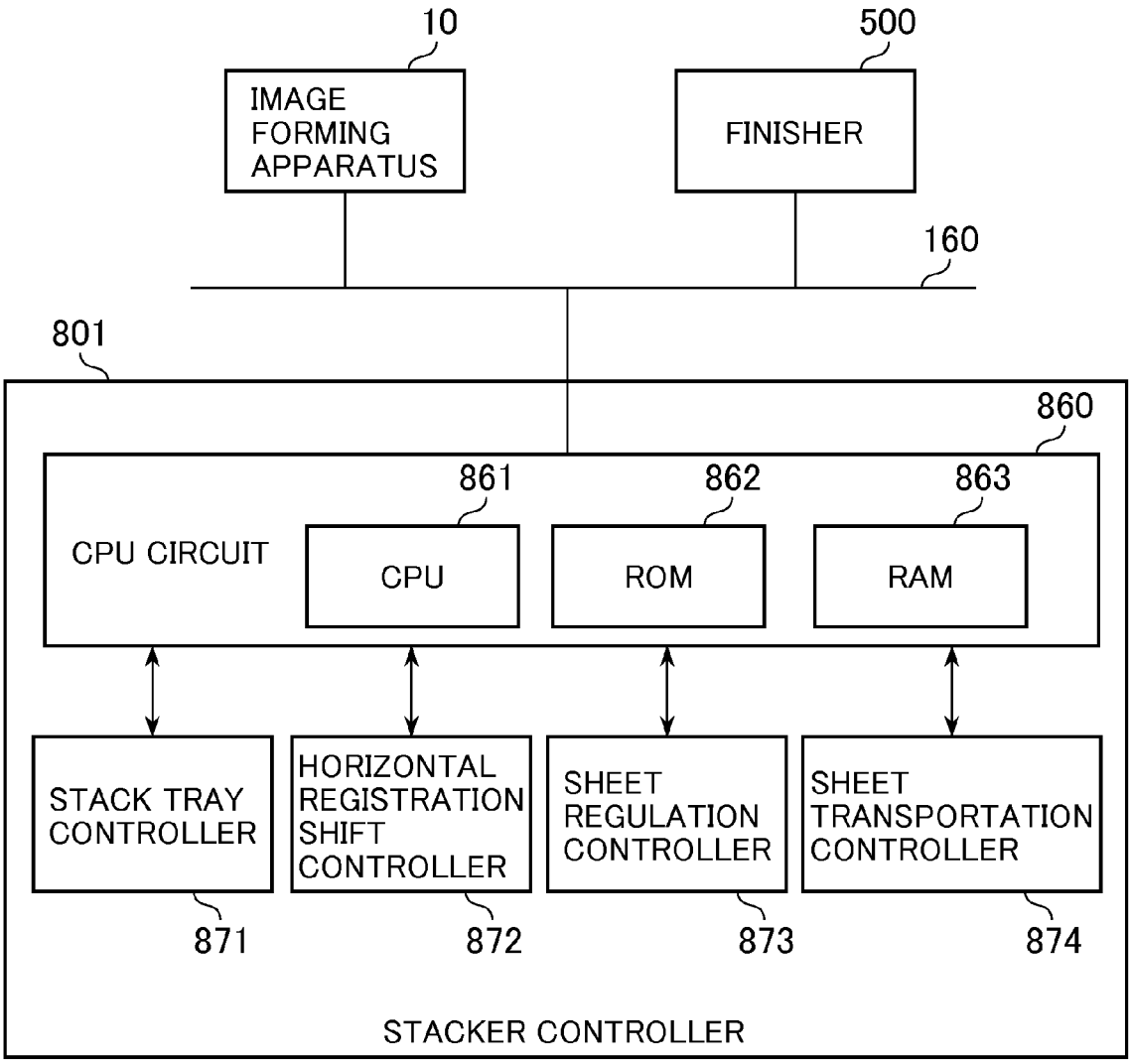
FIG. 6 is a block diagram illustrating an electrical configuration of the stacker controller in FIG. 2.

FIG. 6 is a block diagram illustrating an electrical configuration of the stacker controller 801.

In FIG. 6, the stacker controller 801 includes a CPU circuit 860, a stack tray controller 871, a horizontal registration shift controller 872 (position control unit and detection unit), a sheet regulation controller 873 and a sheet transportation controller 874. The CPU circuit 860 includes a CPU 861, ROM 862 and RAM 863.

The CPU circuit 860 communicates with the CPU circuit 150 of the image forming apparatus 10 and the CPU circuit 560 of the finisher 500 through a communication IC (not shown) and the network 160 to exchange data. The CPU circuit 860 executes various programs stored in the ROM 862 in accordance with an instruction from the CPU circuit 150 in order to drive and control the stacker 800.

The stack tray controller 871 controls the up-and-down movement of the stack tray 821. The horizontal registration shift controller 872 controls the horizontal registration correcting unit 850 as described later. The sheet regulation controller 873 controls the sheet regulating members 822 and 823. The sheet transportation controller 874 controls the transportation of the sheet inside the stacker.

Figure 7A:
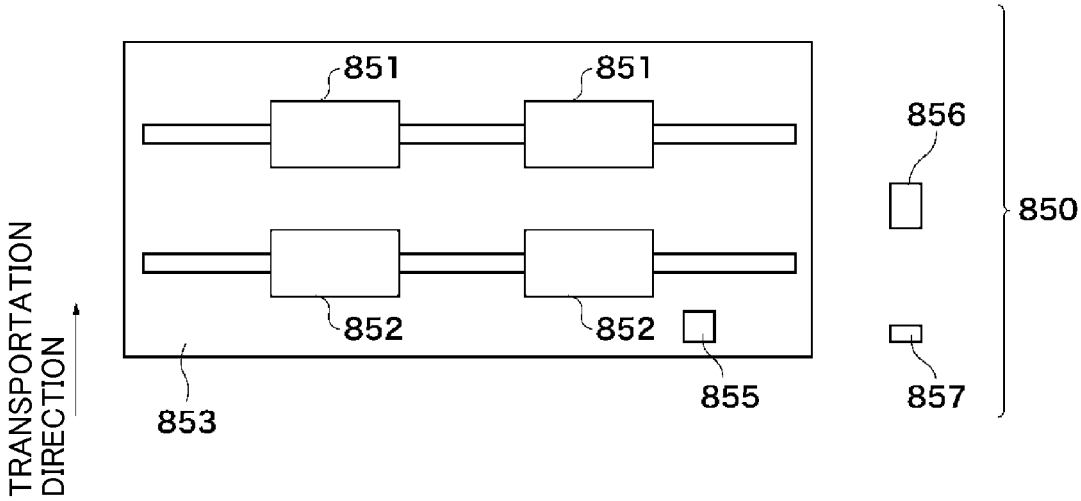
FIG. 7A is a schematic diagram illustrating a mechanical configuration of the horizontal registration correcting unit inside the stacker in FIG. 4.

FIG. 7A is a schematic diagram illustrating a mechanical configuration of the horizontal registration correcting unit 850 inside the stacker 800.

In FIG. 7A, the horizontal registration correcting unit 850 includes a horizontal registration shifting unit 853 having the transportation rollers 851 and 852, a horizontal registration sensor 855, a horizontal registration shift home-position (HP) sensor 856 and a horizontal registration sensor home-position (HP) sensor 857.

The horizontal registration shift controller 872 in FIG. 6 controls the horizontal registration shifting unit 853 and the horizontal registration sensor 855. The transportation rollers 851 and 852 are incorporated into the horizontal registration shifting unit 853. The horizontal registration shifting unit 853 moves the transportation rollers 851 and 852 that sandwich the sheet therebetween in the direction orthogonal to the sheet transportation direction by a motor (not shown), thereby shifting the sheet in the width direction.

The horizontal registration sensor 855 detects the sheet to be transported. The horizontal registration shift HP sensor 856 detects the home position of the horizontal registration shifting unit 853. The horizontal registration sensor HP sensor 857 detects the home position of the horizontal registration sensor 855.

The horizontal registration shifting unit 853 can be moved by the driving force of a motor (not shown) in the width direction (the right-and-left direction in FIG. 7A) orthogonal to the sheet transportation direction. A position where the horizontal registration shifting unit 853 is detected by the horizontal registration shift HP sensor 856 is a home position. The horizontal registration shifting unit 853 stands by in a transport center position when the sheet is transported (refer to FIG. 8).

The horizontal registration sensor 855 can be moved by the driving force of a motor (not shown) in the width direction orthogonal to the sheet transportation direction. A position where the horizontal registration sensor HP sensor 857 is turned on is the home position of the horizontal registration sensor 855. When the sheet is transported, the horizontal registration sensor 855 moves from the home position to an outside position (in the right direction in FIG. 7A) by a half of width of the sheet with respect to the transport center and stands by.

Referring to FIGS. 8 to 11, there is described an example in which the sheet is corrected to a far shift position in respect to the horizontal registration deviation correction control of the sheet.

Figure 8:
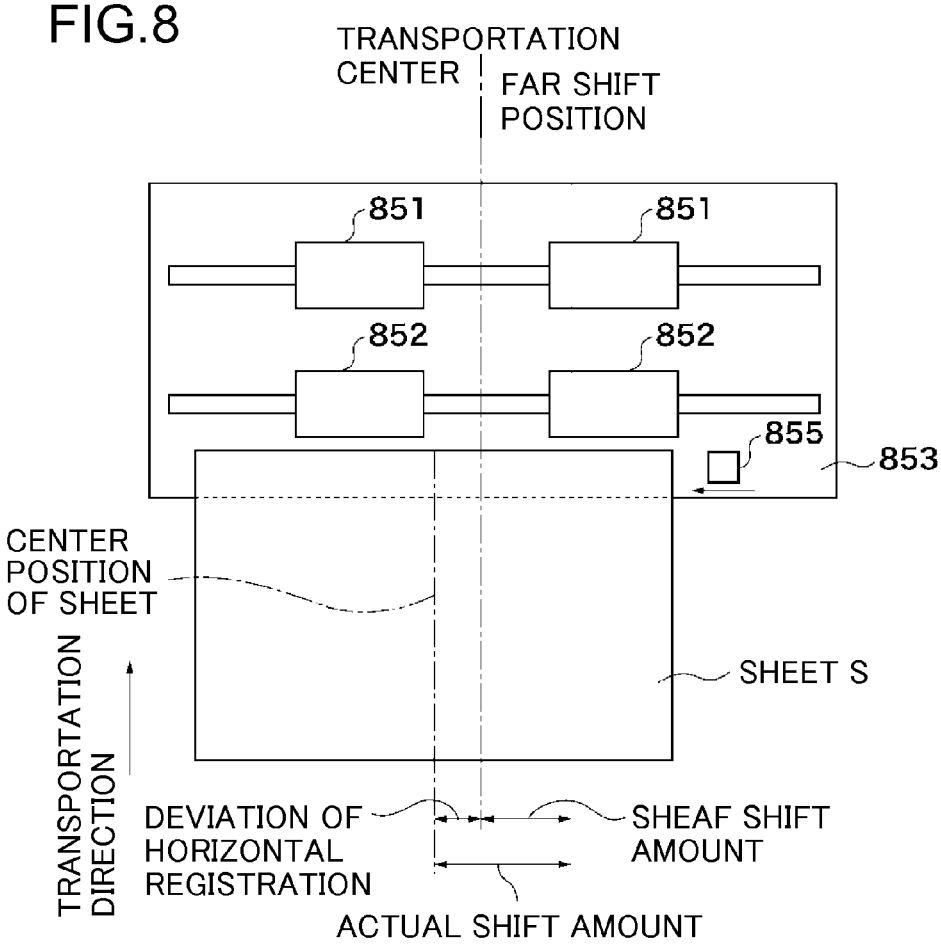
FIG. 8 is a schematic diagram illustrating how the sheet is transported in the stacker in FIG. 7A.

As shown in FIG. 8, when the sheet S is transported and reaches the detection range of the horizontal registration sensor 855, the horizontal registration shift controller 872 moves the horizontal registration sensor 855 outward (in the right direction, i.e., in the direction orthogonal to the transportation direction and away from the transport center). If the horizontal registration sensor 855 does not detect the sheet, the horizontal registration sensor 855 is moved inward (in the left direction, i.e., in the direction orthogonal to the transportation direction and close to the transport center).

The horizontal registration shift controller 872 calculates the amount of a horizontal registration in which the sheet S deviates from the transport center from a displacement of the horizontal registration sensor 855 until a detection signal input from the horizontal registration sensor 855 varies.

The horizontal registration shift controller 872 shifts the horizontal registration shifting unit 853 by a distance (actual shift amount) in which the calculated amount of deviation of a horizontal deviation registration is added to the estimated shift amount (the sheaf shift amount) of the horizontal registration shifting unit 853 with the sheet S sandwiched between the transportation rollers 851 and 852. The deviation amount of a horizontal registration in FIG. 8 refers to the deviation amount of the sheet from the transport center when the transport center does not coincide with the center position of the sheet. The sheaf shift amount refers to the shift amount of sheaf of sheets when a plurality of sheaves of sheets are alternately shifted in the width direction and stacked on the stack tray 821. The actual shift amount refers to an amount in which the deviation amount of a horizontal registration is added to the sheaf shift amount.

Figure 9:
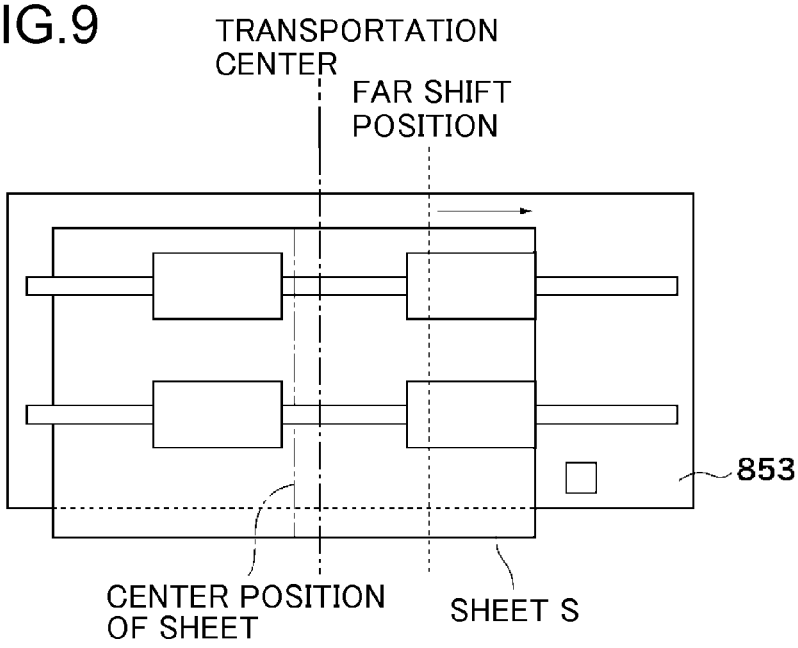
FIG. 9 is a schematic diagram illustrating how the sheet is transported in the stacker in FIG. 7A.
Figure 10:
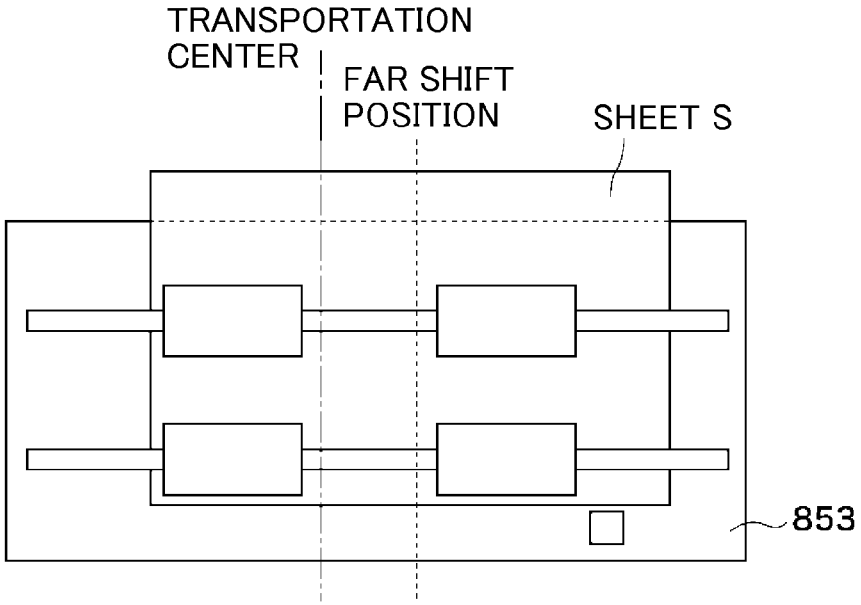
FIG. 10 is a schematic diagram illustrating how the sheet is transported in the stacker in FIG. 7A.
Figure 11:
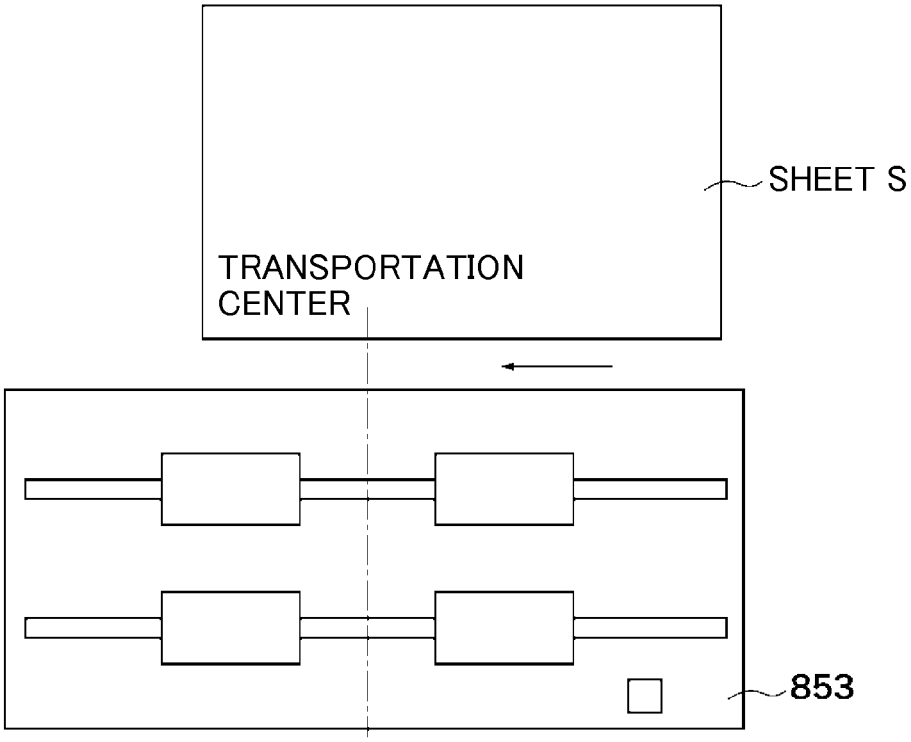
FIG. 11 is a schematic diagram illustrating a state where the horizontal registration shifting unit of the stacker in FIG. 7A is returned to the center position.

As illustrated in FIGS. 9 to 10, when the shift sorting mode is set, the horizontal registration shift controller 872 shifts the horizontal registration shifting unit 853 until the center position of the sheet S coincides with the far shift position (a position shifted rightward (far side) with respect to the transportation direction) and stops it. As illustrated in FIG. 11, after the sheet S has passed the horizontal registration shifting unit 853, the horizontal registration shift controller 872 returns the horizontal registration shifting unit 853 to the transport center position. Incidentally, when the shift sorting mode is not set, the sheet is not shifted by the horizontal registration correcting unit 850. The same holds true with the sheet not being stacked on the stack tray 821 and being transported to the finisher 500.

[Configuration of Finisher Controller]

Figure 12:
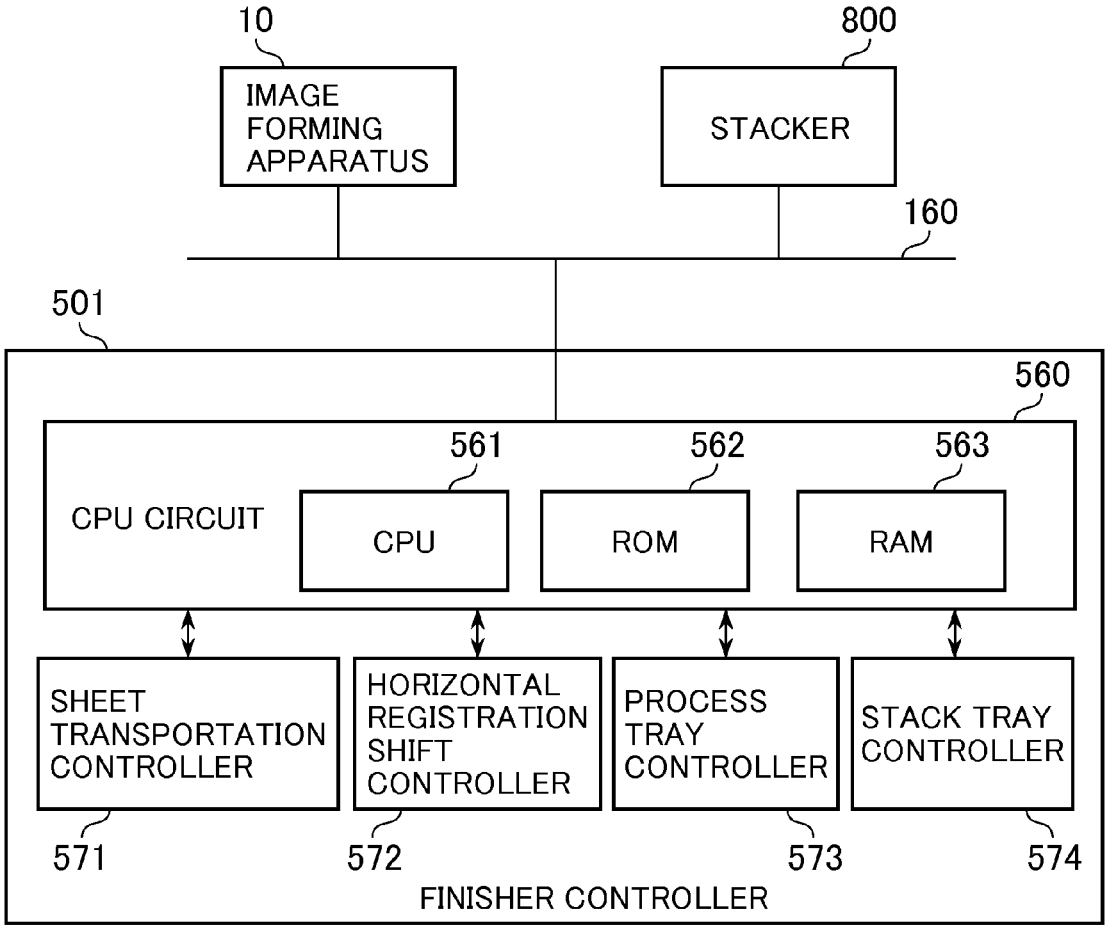
FIG. 12 is a block diagram illustrating an electrical configuration of the finisher controller in FIG. 2.

FIG. 12 is a block diagram illustrating an electrical configuration of the finisher controller 501.

In FIG. 12, the finisher controller 501 includes the CPU circuit 560, a sheet transportation controller 571, a horizontal registration shift controller 572, a process tray controller 573 and a stack tray controller 574. The CPU circuit 560 includes a CPU 561, a ROM 562 and a RAM 563.

The CPU circuit 560 communicates with the CPU circuit 150 of the image forming apparatus 10 and the CPU circuit 860 of the stacker 800 through the communication IC (not shown) and the network 160 to exchange data. The CPU circuit 560 executes various programs stored in the ROM 562 in accordance with an instruction from the CPU circuit 150 in order to drive and control the finisher 500.

The sheet transportation controller 571 controls the transportation of the sheet inside the finisher. The horizontal registration shift controller 572 controls the horizontal registration correcting unit 550. The process tray controller 573 controls the aligning process and the stapling process on the process tray 630. The stack tray controller 574 controls the up-and-down movements of the stack trays 700 and 701.

Figure 7B:
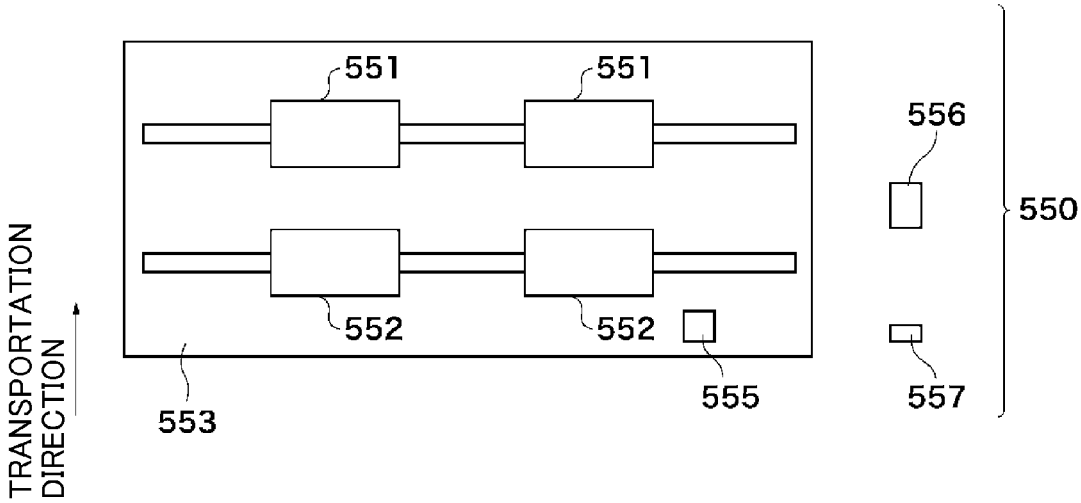
FIG. 7B is a schematic diagram illustrating a mechanical configuration of the horizontal registration correcting unit of the finisher in FIG. 5.

FIG. 7B is a schematic diagram illustrating a mechanical configuration of the horizontal registration correcting unit 550 of the finisher 500.

In FIG. 7B, the horizontal registration correcting unit 550 includes a horizontal registration shifting unit 553 having the transportation rollers 551 and 552, a horizontal registration sensor 555, a horizontal registration shift HP sensor 556 and a horizontal registration sensor HP sensor 557. The horizontal registration correcting unit 550 performs control in the same manner as the horizontal registration correcting unit 850 of the stacker 800, so that the description thereof is omitted.

The operations of the stacker 800 and the finisher 500 of the image forming system according to this embodiment with the above configuration in the respective modes will be described with reference to FIGS. 1 to 22. In this embodiment, there are described a stacker shift sorting mode, a finisher shift sorting mode, a finisher staple sorting mode and a horizontal registration deviation correction alternative mode.

[Stacker Shift Sorting Mode]

Figure 13:
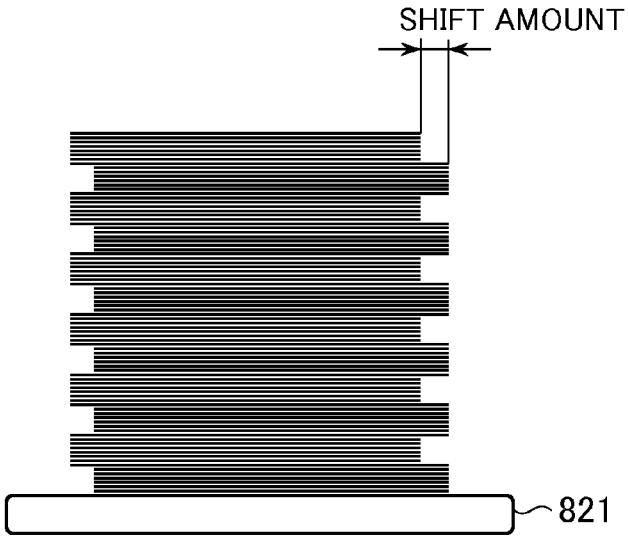
FIG. 13 is a schematic diagram illustrating a state where sheaves of sheets are stacked on the stack tray of the stacker in FIG. 4.

Referring to FIGS. 4 and 13, there is described the transportation control of the sheet in the stacker shift sorting mode in which the sheaf of sheets is stacked on the stack tray 821 of the stacker 800.

When a user selects the "stacker" as an ejection place and the "shift sorting" as a paper ejection mode through the operation display 400 of the image forming apparatus 10, the stacker controller 801 performs the following sheet stack control. As illustrated in FIG. 13, the sheaves of sheets are stacked on the stack tray 821 of the stacker 800 so that one set (unit of sheaf of sheets) is shifted from another set.

The sheet ejected from the image forming apparatus 10 is pulled into the stacker through the sheet inlet portion 811 of the stacker 800 and led to the horizontal registration correcting unit 850 through the transportation path 812. The horizontal registration correcting unit 850 shifts the sheet in the width direction orthogonal to the transportation direction as described above. The stacker controller 801 alternately switches the shift direction between the left side (the front side of the paper surface in FIG. 4) and the right side (the back side of the paper surface in FIG. 4) with respect to the transportation direction every set of the sheets.

The sheet shifted by and ejected from the horizontal registration correcting unit 850 is led from the transportation path 812 to the transportation path 813 by the switching flapper 815 and ejected to the stack tray 821. As illustrated in FIG. 13, the sheaves of sheets are stacked on the stack tray 821 so that one set is shifted from another set.

[Finisher Shift Sorting Mode]

Figure 14:
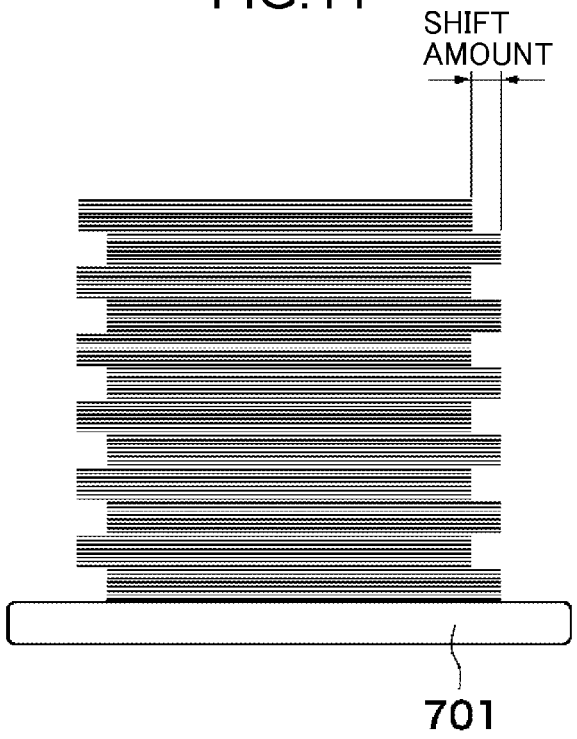
FIG. 14 is a schematic diagram illustrating a state where sheaves of sheets are stacked on the stack tray of the finisher in FIG. 5.

Referring to FIGS. 5 and 14, there is described the transportation control of the sheet in the finisher shift sorting mode in which the sheaf of sheets is stacked on the stack tray 701 on the upper stage side of the finisher 500.

When a user selects the "finisher" as an ejection place and the "shift sorting mode" as a paper ejection mode through the operation display 400 of the image forming apparatus 10, the finisher controller 501 performs the following sheet stack control. As illustrated in FIG. 14, the sheaves of sheets are stacked on the stack tray 701 of the finisher 500 so that one set is shifted from another set.

The sheet ejected from the image forming apparatus 10 is pulled into the stacker through the sheet inlet portion 811 of the stacker 800. The sheet is led to the horizontal registration correcting unit 850 through the transportation path 812, but the shift process by the horizontal registration correcting unit 850 is not applied and the sheet passes there as is. Thereafter, the sheet is led to the transportation path 814 by the switching flapper 815 and transported into the finisher by the pair of inlet rollers 502 of the finisher 500.

The sheet transported into the finisher is led to the horizontal registration correcting unit 550. The horizontal registration correcting unit 550 shifts the sheet in the width direction orthogonal to the transportation direction as described above. The finisher controller 501 alternately switches the shift direction between the left side (the front side of the paper surface in FIG. 5) and the right side (the back side of the paper surface in FIG. 5) with respect to the transportation direction every set of the sheets.

The sheet shifted by and ejected from the horizontal registration correcting unit 550 is led to the transportation path 521 by the switching flapper 511. When the paper ejecting sensor 533 detects the rear end of the sheet, the pair of ejecting rollers 509 rotate at a speed suited for stacking the sheet on the stack tray 701 to eject the sheet to the stack tray 701. As illustrated in FIG. 14, the sheaves of sheets are stacked on the stack tray 701 so that one set is shifted from another set.

[Finisher Staple Sorting Mode]

Referring to FIG. 5 and FIGS. 15 to 17, there is described the transportation control of the sheet in the finisher staple sorting mode in which the sheaf of sheets is stacked on the stack tray 700 of the finisher 500 after the sheaf of sheets has been stapled.

When a user selects the "staple sorting mode" as a paper ejection mode through the operation display 400 of the image forming apparatus 10, the finisher controller 501 performs the following sheet stack control. The sheaves of sheets are stapled on a set-by-set basis by the finisher 500 and then stacked on the stack tray 700.

The sheet ejected from the image forming apparatus 10 is pulled into the stacker through the sheet inlet portion 811 of the stacker 800. The sheet is led to the horizontal registration correcting unit 850 through the transportation path 812, but the shift process by the horizontal registration correcting unit 850 is not applied and the sheet passes there as is. Thereafter, the sheet is led to the transportation path 814 by the switching flapper 815 and transported into the finisher by the pair of inlet rollers 502 of the finisher 500.

Figure 15:
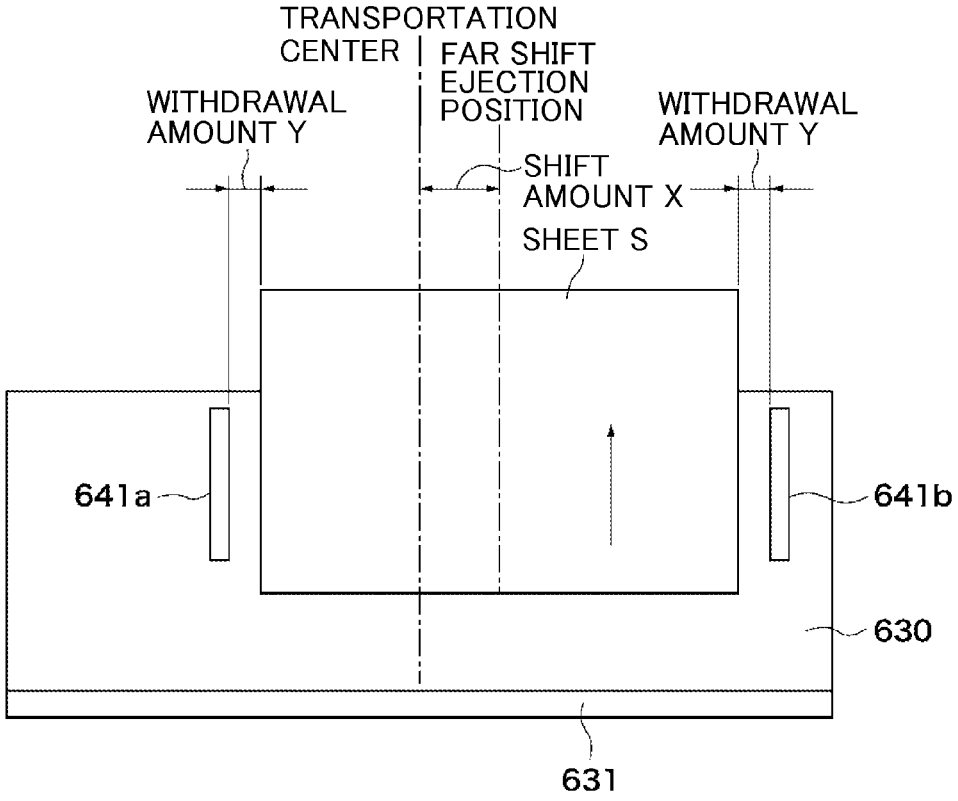
FIG. 15 is a diagram illustrating the flow of the sheet in a staple sorting mode in the finisher in FIG. 5.

The sheet transported into the finisher is led to the horizontal registration correcting unit 550. The horizontal registration correcting unit 550 shifts the sheet in the width direction orthogonal to the transportation direction as described above. The finisher controller 501 alternately switches the shift direction between the left side (the front side of the paper surface in FIG. 5) and the right side (the back side of the paper surface in FIG. 5) with respect to the transportation direction every set of the sheets. As illustrated in FIG. 15, there is described herein the case where the sheet is shifted to the back side by a shift amount X.

The switching flappers 510 and 511 are stopped in positions shown in FIG. 5 and the sheet is led to the transportation path 522. The sheet led to the transportation path 522 is ejected to the process tray 630 by the pair of transportation rollers 507. A retractable tray (not shown) projecting upward prevents the sheet ejected by the pair of transportation rollers 507 from trailing down and returning at the time of ejection and improves an alignment of the sheet on the process tray 630.

The sheet ejected to the process tray 630 is corrected in deviation of horizontal registration by the horizontal registration correcting unit 550 and moved to a far shift ejection position (to the position on the right with respect to the transportation direction (on the back of the paper surface in FIG. 5)) by the shift amount X from the transportation center. Thereby, the aligning member 641 stands by in the following manner. Both the aligning member 641*a* on the left (the front side of the paper surface in FIG. 5) with respect to the transportation direction and the aligning member 641*b* on the right (the back side of the paper surface in FIG. 5) with respect to the transportation direction are withdrawn by a withdrawal amount Y with respect to a position where the shifted sheet on the process tray 630 is stacked and stand by.

The aligning members 641*a* and 641*b* stand by with maintaining a distance slightly wider than the width of the sheet because a sheet transportation distance between the horizontal registration correcting unit 550 and the process tray 630 is short and therefore a deviation of horizontal registration occurring after the sheet has been shifted is very small. This enables to decrease the moving amount of the aligning members 641*a* and 641*b* at the time of an aligning operation to shorten the time required for alignment, achieving high productivity (improvement in the number of sheets to be processed in unit time).

Figure 16:
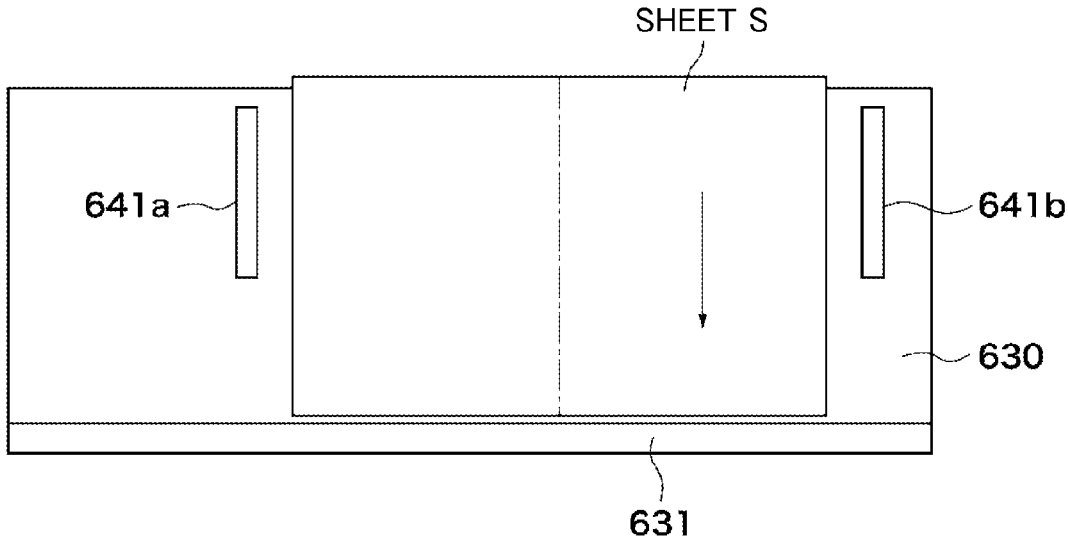
FIG. 16 is a diagram illustrating the flow of the sheet in a staple sorting mode in the finisher in FIG. 5.
Figure 17:
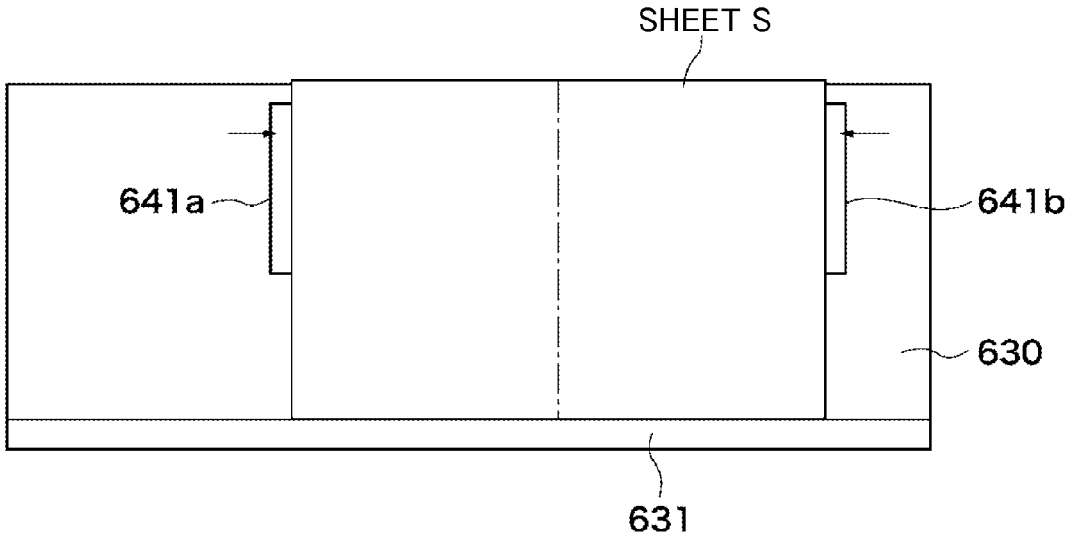
FIG. 17 is a diagram illustrating the flow of the sheet in a staple sorting mode in the finisher in FIG. 5.

As illustrated in FIGS. 15 to 16, the sheet ejected onto the process tray 630 starts moving on the process tray 630 toward a stopper 631 by its own weight. The assisting member such as the paddle 660 (FIG. 5) and a returning belt (not shown) assists in moving the sheet on the process tray 630. When the rear end of the sheet abuts on the stopper 631 and the sheet stops, the aligning members 641*a* and 641*b* move in the arrow direction as illustrated in FIG. 17 to align the sheet.

Thereafter, the ejecting rollers 680*a* and 680*b* illustrated in FIG. 5 perform a sheaf ejection operation with the sheaf of sheets sandwiched therebetween to eject the sheaf of sheets to the stack tray 700. The sheaves of sheets are stacked on the process tray 630 with being alternately offset by the aligning members 641*a* and 641*b* and ejected. Thereby, the sheets of each sheaf are stacked so that the top page whose image formation surface faces downward positions at the bottom and the following pages are sequentially stacked in the order of pages The sheaves of sheets are sequentially stacked on the stack tray 700.

[Horizontal Registration Deviation Correction Alternative Mode and Function Limitation Mode]

Figure 18:
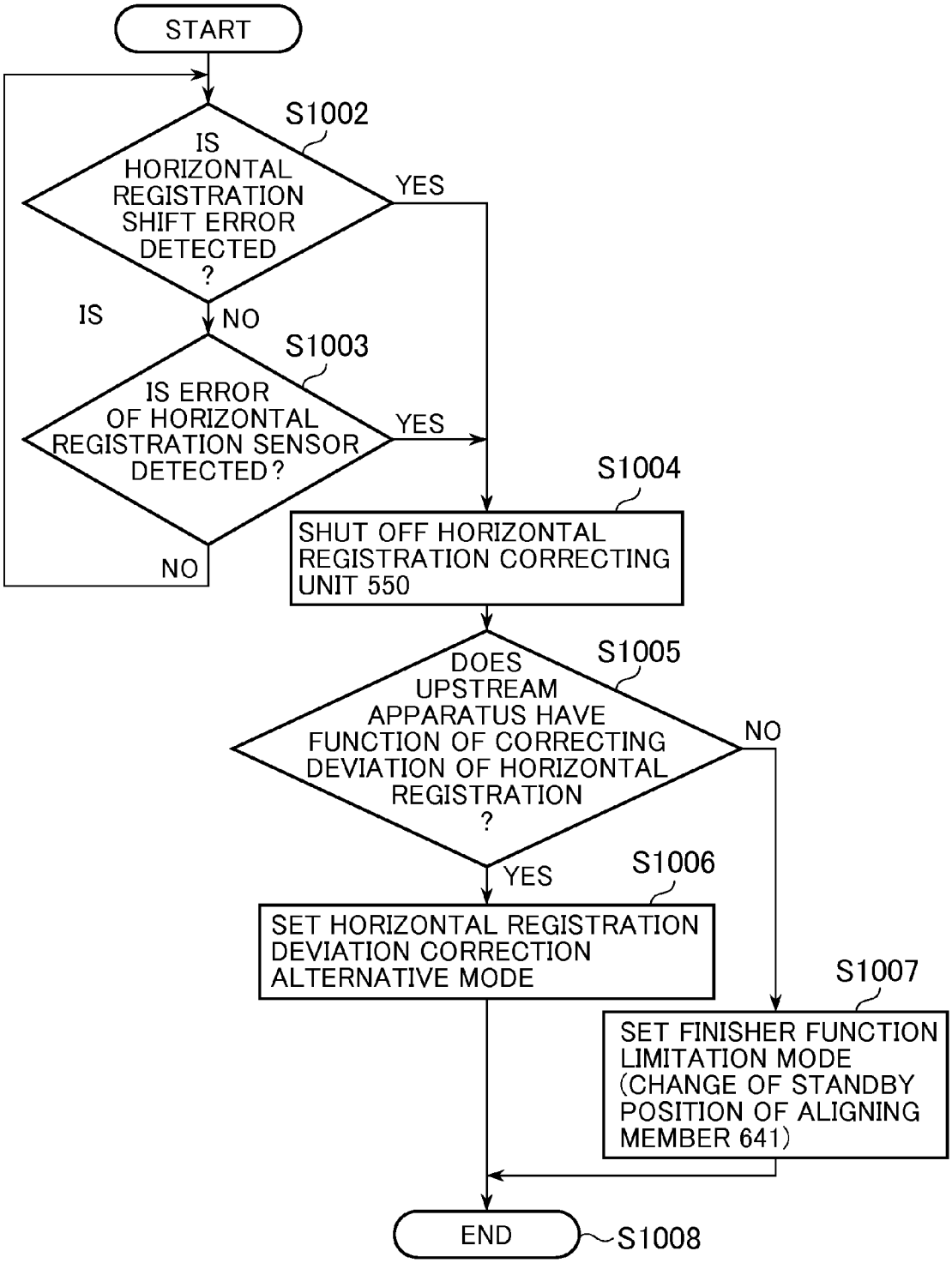
FIG. 18 is a flow chart illustrating a process of a transition from any mode to a horizontal registration deviation correction alternative mode and a function limitation mode in the image forming system in FIG. 1.

Referring to FIG. 18, there is described a transition to a horizontal registration deviation correction alternative mode and a function limitation mode of the finisher 500.

FIG. 18 is a flow chart illustrating a process of a transition from any mode to a horizontal registration deviation correction alternative mode and a function limitation mode. Incidentally, in the horizontal registration deviation correction alternative mode (hereinafter, referred to as correction alternative mode), when a horizontal registration cannot be corrected in the finisher 500, a horizontal registration can be corrected by a horizontal registration correction unit provided on another apparatus. In the function limitation mode, the distance between the standby positions of the aligning member 641 is made greater than the normal distance and an interval during which the sheet is ejected from the image forming apparatus is made greater than the normal interval.

In FIG. 18, after the present process is started, if the horizontal registration correcting unit 550 causes a phenomenon described in the following item (1) or (2), the horizontal registration shift controller 572 of the finisher controller 501 detects the phenomenon as a horizontal registration shift error (step S1002).

(1) When the horizontal registration shifting unit 553 returns to the home position, the horizontal registration shift HP sensor 556 does not turn ON even if a predetermined time passes.

(2) When the horizontal registration shifting unit 553 moves from the home position to the transport center position, the horizontal registration shift HP sensor 556 does not turn OFF even if a predetermined time passes.

Similarly, if the horizontal registration correcting unit 550 causes a phenomenon described in the following item (3) or (4), the horizontal registration shift controller 572 detects the phenomenon as a horizontal registration sensor error (step S1003).

(3) When the horizontal registration sensor 555 returns to the home position, the horizontal registration sensor HP sensor 557 does not turn ON even if a predetermined time passes.

(4) When the horizontal registration sensor 555 moves from the home position to the standby position, the horizontal registration sensor HP sensor 557 does not turn OFF even if a predetermined time passes.

If any error is detected in the horizontal registration shifting unit 553 and the horizontal registration sensor 555, the CPU 561 of the finisher controller 501 notifies the CPU circuit 150 of the image forming apparatus 10 that an error occurred. The CPU 561 gives the horizontal registration shift controller 572 instructions to prohibit the horizontal registration correcting unit 550 from correcting the deviation of horizontal registration. Thereby, the horizontal registration shift controller 572 shuts off a power supply of a part related to the correction of the deviation of horizontal registration in the horizontal registration correcting unit 550 (step S1004). In other words, a function in which the transportation rollers 551 and 552 transport the sheet downstream remains effective.

The horizontal registration shift controller 572 determines whether the sheet process apparatus (the stacker 800) on the upstream side has a function of correcting deviation of horizontal registration similar to the finisher 500 (step S1005). The determination can be made by communication when the power supply of the system is turned on. If the sheet process apparatus on the upstream side has the similar function of correcting deviation of horizontal registration, the horizontal registration shift controller 572 sets the deviation correction alternative mode (step S1006). That is, even when the sheet is ejected to the finisher 500, the horizontal registration shift controller 572 performs the horizontal registration deviation correction of the sheet using the horizontal registration correcting unit 850 of the sheet process apparatus (the stacker 800) on the upstream side instead of using the horizontal registration correcting unit 550.

If the sheet process apparatus on the upstream side does not have the similar function of correcting deviation of horizontal registration, the horizontal registration shift controller 572 sets the function limitation mode in which the function of the finisher 500 is limited (step S1007). The horizontal registration shift controller 572 makes the distance between the standby positions of the aligning member 641 greater than the normal distance and instructs the image forming apparatus to make an interval during which the sheet is ejected greater than the normal interval. In this case, the aligning member 641 withdraws by a withdrawal amount W illustrated in FIG. 21 and stands by at the position. For this reason, even if the deviation of horizontal registration is greater than a value at the horizontal registration correcting unit 550 in a normal state during the transportation of the sheet to the aligning member 641, the sheet will not collide with the aligning member 641.

When the setting is finished in step S1006 or in step S1007, the present process is finished (step S1008).

Figure 19:
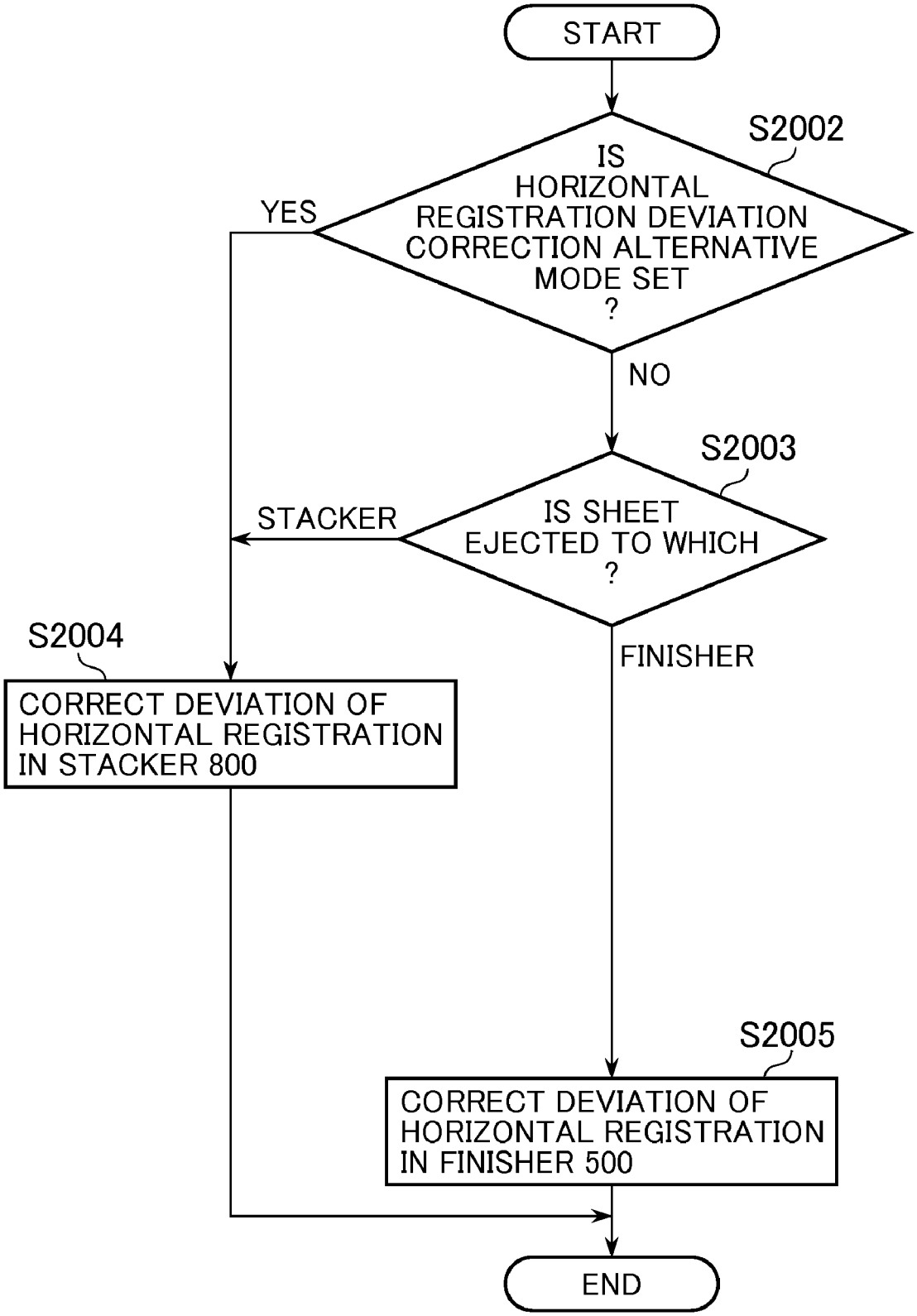
FIG. 19 is a flow chart illustrating the process in the image forming system in FIG. 1 according to the first embodiment where the horizontal registration variation correction alternative mode is set and is not set.

Referring to FIG. 19, there is described below the processes in the case where the correction alternative mode is set and is not set.

FIG. 19 is a flow chart illustrating the processes in the case where the correction alternative mode is set and is not set.

In FIG. 19, when the present process is started, the CPU circuit 150 of the image forming apparatus 10 determines through the communication of the finisher controller 501 whether the correction alternative mode is set (step S2002). When the CPU circuit 150 determines that the correction alternative mode is not set, the CPU circuit 150 determines whether a sheet ejection place specified after a user has set a job is the "stacker" or the "finisher" (step S2003).

When the CPU circuit 150 determines that the specified sheet ejection place is the "stacker," the CPU circuit 150 instructs the stacker controller 801 to execute the following process (step S2004). When a post-process including a shift is set, the horizontal registration correcting unit 850 of the stacker 800 corrects the deviation of horizontal registration of the sheet and shifts the sheet. The stacker 800 performs the horizontal registration deviation correction and shift in accordance with the instruction, after that, the sheet is led to the transportation path 813 by the switching flapper 815 to stack the sheet on the stack tray 821.

When the CPU circuit 150 determines that the specified sheet ejection place is the "finisher," the CPU circuit 150 instructs the finisher controller 501 to execute the following process (step S2005). That is, when a post-process including a shift is set, the CPU circuit 150 instructs the horizontal registration correcting unit 550 of the finisher 500 to correct the deviation of horizontal registration of the sheet and shift the sheet. In this case, the CPU circuit 150 does not instruct the stacker controller 801 to cause the horizontal registration correcting unit 850 to move the sheet in the width direction.

On the other hand, when the CPU circuit 150 determines that the correction alternative mode is set, the CPU circuit 150 instructs the execution of the following process (step S2004). That is, when a post-process including a shift is set, the CPU circuit 150 instructs the horizontal registration correcting unit 850 of the stacker 800 to correct the deviation of horizontal registration of the sheet.

Thereby, even if an abnormal condition occurs at the horizontal registration correcting unit 550 of the finisher 500, the horizontal registration correcting unit 850 of the stacker 800 can be caused to correct the deviation of horizontal registration of the sheet instead. Accordingly, it is enabled to prevent the image forming apparatus from decreasing in capability.

Second Embodiment

Incidentally, if the sheet is shifted in the stacker 800 instead of in the horizontal registration correcting unit 550 of the finisher 500, the transportation distance is increased between a position where the deviation of horizontal registration of the sheet is corrected and the process tray 630. Furthermore, the sheet is transferred from the stacker 800 to the finisher 500 after the deviation of horizontal registration has been corrected. This can make greater a deviation caused after the deviation of horizontal registration has been corrected as compared with the case where the sheet is shifted in a single sheet process apparatus (any one of the stacker 800 or the finisher 500).

The second embodiment adapts the deviation of horizontal registration of the sheet caused after the deviation of horizontal registration of the sheet has been corrected, when the sheet is shifted in the stacker 800.

Figure 20:
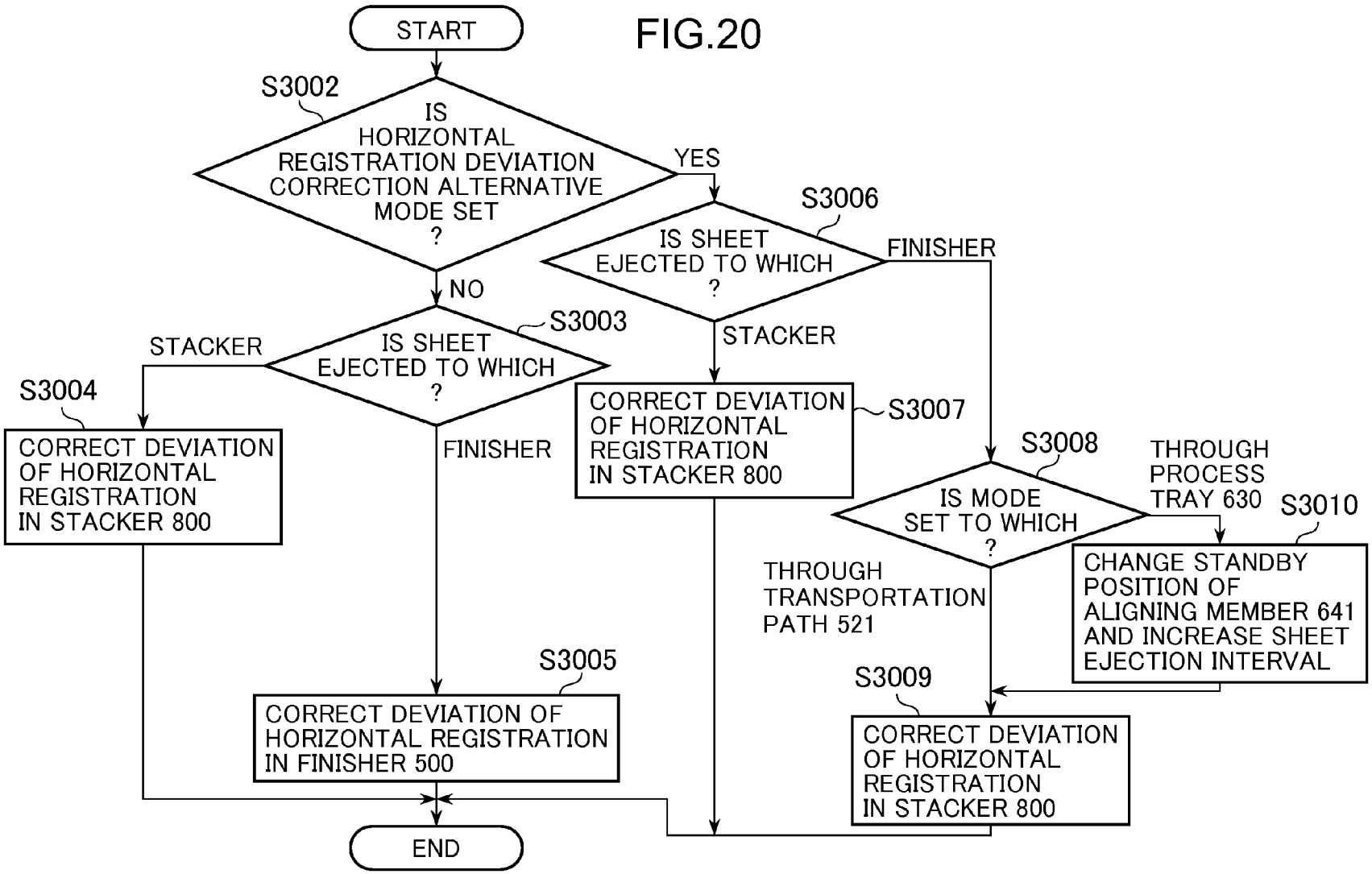
FIG. 20 is a flow chart illustrating the process in the image forming system in FIG. 1 according to the second embodiment where the horizontal registration variation correction alternative mode is set and is not set.

FIG. 20 is a control flow chart of the CPU circuit 150 in the second embodiment.

In FIG. 20, when the present process is started, the CPU circuit 150 of the image forming apparatus 10 determines through the communication of the finisher controller 501 whether the correction alternative mode is set (step S3002). When the CPU circuit 150 determines that the correction alternative mode is not set, the CPU circuit 150 determines whether a sheet ejection place specified after a user has set a job is the "stacker" or the "finisher" (step S3003).

When the CPU circuit 150 determines that the specified sheet ejection place is the "stacker," the CPU circuit 150 instructs the stacker controller 801 to execute the following process (step S3004). That is, when a post-process including a shift is set, the CPU circuit 150 instructs the horizontal registration correcting unit 850 of the stacker 800 to correct the deviation of horizontal registration of the sheet and shift the sheet. The stacker 800 corrects the deviation of horizontal registration of the sheet and shifts the sheet in accordance with the instruction, and the sheet is led to the transportation path 813 by the switching flapper 815 to stack the sheet on the stack tray 821.

When the CPU circuit 150 determines that the specified sheet ejection place is the "finisher" and a post-process including an alignment process or a shift is set, the CPU circuit 150 instructs the finisher controller 501 to execute the following process (step S3005). That is, when a post-process including a shift is set, the CPU circuit 150 instructs the horizontal registration correcting unit 550 of the finisher 500 to correct the deviation of horizontal registration of the sheet or shift the sheet. In this case, the CPU circuit 150 does not instruct the stacker controller 801 to cause the horizontal registration correcting unit 850 to move the sheet in the width direction.

On the other hand, when the CPU circuit 150 determines that the correction alternative mode is set, the CPU circuit 150 instructs determines whether a sheet ejection place specified to the inputted job is the "stacker" or the "finisher" (step S3006).

When the CPU circuit 150 determines that the specified sheet ejection place is the "stacker," the CPU circuit 150 instructs the stacker controller 801 to execute the following process (step S3007). The CPU circuit 150 instructs the stacker controller 801 to cause the horizontal registration correcting unit 850 of the stacker 800 to correct the deviation of horizontal registration of the sheet and shift the sheet. The stacker 800 correct the deviation of horizontal registration of the sheet and shift the sheet in accordance with the instruction, and the sheet is led to the transportation path 813 by the switching flapper 815 to stack the sheet on the stack tray 821.

When the CPU circuit 150 determines that the specified sheet ejection place is the "finisher," the CPU circuit 150 determines whether the paper ejection mode specified by a user is the "shift sorting mode" through the transportation path 521, the "shift sorting mode" through the process tray 630 or the "staple sorting mode" (step S3008).

When the CPU circuit 150 determines that the sheet ejection mode is the "shift sorting mode" through the transportation path 521, the CPU circuit 150 instructs the stacker controller 801 and the finisher controller 501 to execute the following process (step S3009). Even if the specified sheet ejection place is the "finisher," the horizontal registration correcting unit 850 of the stacker 800 corrects the deviation of horizontal registration of the sheet and shifts the sheet. The stacker 800 corrects the deviation of horizontal registration and shifts the sheet in accordance with the instruction, after that, stacker 800 transfers the sheet to the finisher 500. The finisher 500 leads the sheet by the switching flapper 511 to the transportation path 521 and stacks the sheet on the stack tray 701.

When the CPU circuit 150 determines that the sheet ejection mode is the "shift sorting mode" through the process tray 630, the CPU circuit 150 instructs the finisher controller 501 to execute the following process (step S3010). The standby position of the aligning member 641 (641*a* and 641*b*) is changed and an interval during which the sheet is ejected from the image forming apparatus is increased. Step S3010 is described below in detail.

The CPU circuit 150 causes the stacker controller 801 and the finisher controller 501 to execute the following process. In other words, the CPU circuit 150 instructs the horizontal registration correcting unit 850 of the stacker 800 to correct the deviation of horizontal registration of the sheet and shift the sheet as in the case of specifying "shift sorting mode" through the transportation path 521. Thereafter, the sheet is transferred from the stacker 800 to the finisher 500 and the finisher 500 leads the sheet by the switching flapper 511 to the transportation path 522 and stacks the sheet on the process tray 630.

When the correction of the deviation of horizontal registration is finished in steps S3004, S3005, S3007 or S3009, the present process finishes.

Figure 21:
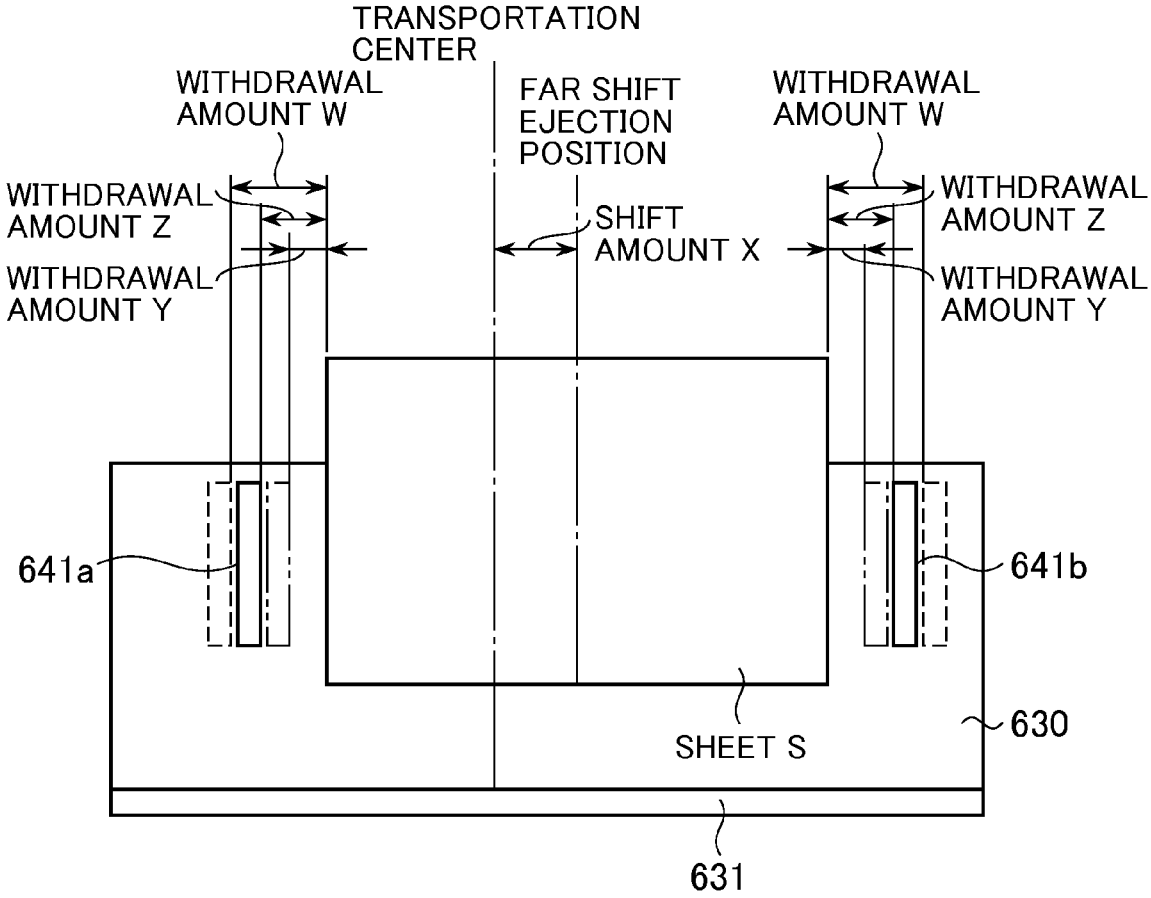
FIG. 21 is a diagram illustrating the staple sorting process in the horizontal registration variation correction alternative mode of the finisher in FIG. 5.

When the standby position of the aligning member 641 is changed in step S3010, the aligning members 641*a* and 641*b* of the process tray 630 are caused to stand by with the standby positions thereof being made wider than the normal position as illustrated in FIG. 21. In FIG. 21, a widened withdrawal amount is taken as Z with respect to a normal withdrawal amount Y of the aligning members 641*a* and 641*b* (Z>Y). The aligning members 641*a* and 641*b* are caused to stand by at the standby positions thereof being made wider by an amount of (Z−Y) than the normal standby positions. Incidentally, the withdrawal amount Z is smaller than the withdrawal amount W of the aligning member 641 in step S1007 of FIG. 18.

In FIG. 21, for the withdrawal amount Y, the aligning members 641*a* and 641*b* are positioned at first standby positions (normal positions where the aligning members stand by with respect to the stack position of the sheet on the process tray 630). For the withdrawal amount Z, the aligning members 641*a* and 641*b* are positioned at second standby positions (positions where the aligning members stand by farther outward than the first standby positions in the width direction of the sheet). For the withdrawal amount W, the aligning members 641*a* and 641*b* are positioned at third standby positions (positions where the aligning members stand by farther outward than the second standby positions in the width direction of the sheet).

Figure 22:
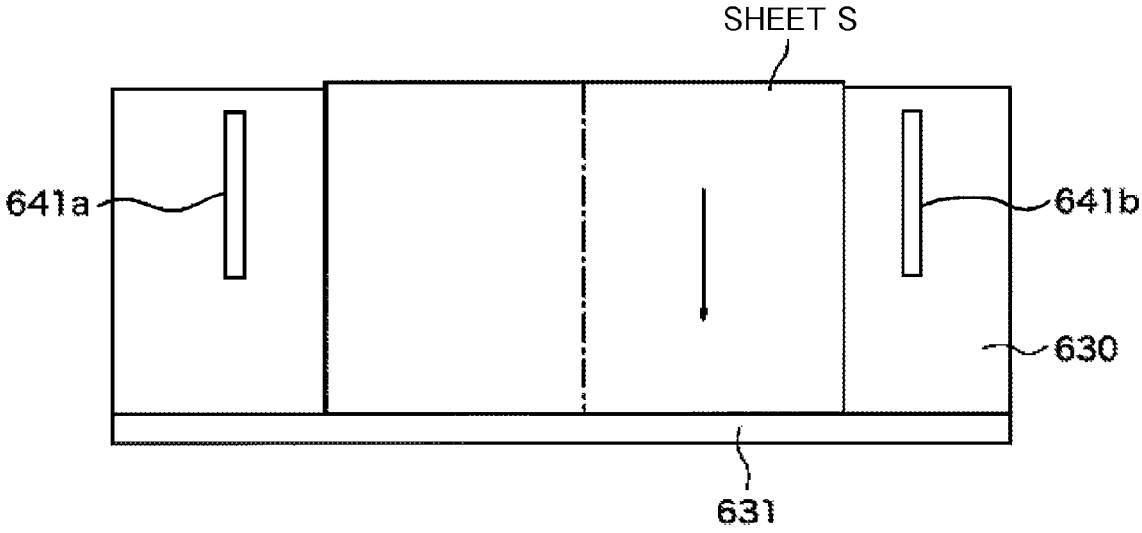
FIG. 22 is a diagram illustrating the staple sorting process in the horizontal registration variation correction alternative mode of the finisher in FIG. 5.
Figure 23:
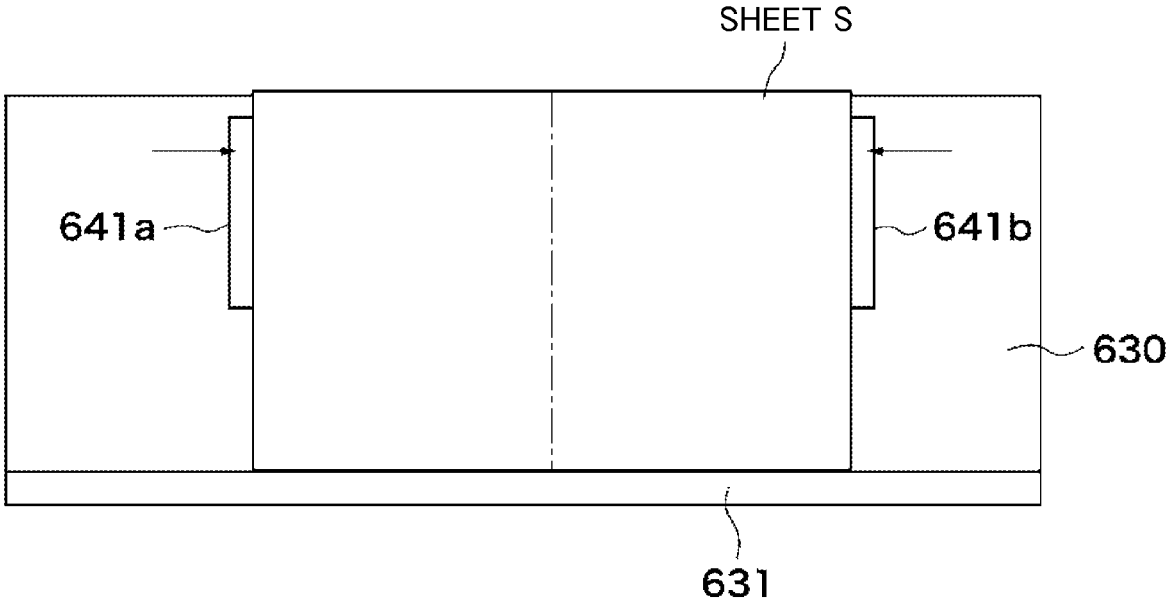
FIG. 23 is a diagram illustrating the staple sorting process in the horizontal registration variation correction alternative mode of the finisher in FIG. 5.

This increases the moving amount of the aligning members 641*a* and 641*b* at the time of aligning operation as illustrated in FIGS. 22 and 23, which also increases an aligning process time required at the time of the sheet entering the process tray 630. For this reason, in step S3010 of FIG. 20, when the withdrawal amount of the aligning members 641*a* and 641*b* is increased, an interval during which the sheet is ejected from the image forming apparatus 10 to the stacker 800 is also increased by a time corresponding to the increased aligning process time.

Specifically, an interval during which the sheet is ejected from the image forming apparatus is increased by a difference between the time required for the aligning operation starting from the first standby position and the time required for the aligning operation starting from the second standby position in the aligning members 641*a* and 641*b*. At this point, the sheet ejection interval is shorter than the sheet ejection interval for the withdrawal amount W.

As described above, according to the present embodiment, the image forming system in which a plurality of the sheet process apparatus (the stacker 800 and the finisher 500) is coupled to the image forming apparatus achieves the following effects. The CPU circuit 150 of the image forming apparatus 10 performs the following control if the CPU circuit 150 detects an abnormal condition in the horizontal registration correcting unit 550 of the finisher 500 when the sheet ejected from the image forming apparatus is transported to the finisher 500 and stacked on the tray with a position being changed in the width direction of the sheet. The CPU circuit 150 controls such that the horizontal registration correcting unit 850 of the stacker 800 changes a position in the width direction orthogonal to the transportation direction of the sheet and the sheet is transported to the finisher 500. This enables reduction in downtime of the image forming system even if an abnormal condition occurs at the horizontal registration correcting unit 550.

Another Embodiment

Although the above present embodiment takes as an example the image forming system in which two sheet process apparatuses (the stacker and the finisher) are coupled to the image forming apparatus, the present invention is not limited to this embodiment. The number of the sheet process apparatus coupled to the image forming apparatus may be determined in accordance with the specifications of a system.

When the sheet ejection place is set to the finisher 500, and even if an abnormal condition is not detected in the horizontal registration correcting unit 550, the horizontal registration correcting unit 850 of the stacker 800 may be caused to correct the deviation of horizontal registration of the sheet. In other words, even when the sheet ejection place is not set to the stacker 800, the horizontal registration correcting unit 850 of the stacker 800 may be caused to correct the deviation of horizontal registration of the sheet. This enables preventing the deviation of horizontal registration from exceeding a correctable amount at the time of the finisher 500 receiving the sheet. In this case, the stacker 800 and the finisher 500 correct twice the deviation of horizontal registration of the sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 2008-042963, filed on Feb. 25, 2008, and Japanese Patent Application No. 2009-040373, filed on Feb. 24, 2009, which is hereby incorporated by reference herein in its entirety.

What is claimed is:

1. A control method for an image forming system including an image forming apparatus forming an image on a sheet and a first sheet process apparatus having a first moving unit that receives the sheet on which the image is formed by said image forming apparatus and moves the position of the sheet in a width direction orthogonal to the direction in which the sheet is transported, the control method comprising:

a determination step for determining whether a second sheet process apparatus having a second moving unit which moves the position of the sheet in the width direction is connected to a side further upstream than said first sheet process apparatus;

a detection step for detecting an abnormal condition of said first moving unit; and a sheet movement step for causing said second moving unit to change the position of the sheet in the width direction while the sheet is transported along said second sheet process apparatus if an abnormal condition is detected in said detection step and it is determined that said second sheet process apparatus is connected in said determination step.

2. The control method for the image forming system according to claim 1, wherein said second moving unit detects the position of the sheet in the width direction and moves the sheet in the width direction based on a difference between the detected position and a reference position.

3. The control method for the image forming system according to claim 1, wherein said first sheet process apparatus has a pair of aligning members provided further downstream than said first moving unit, aligns both sides of the sheet in the width direction; the control method further comprises:

a first aligning member control step for setting a distance between said pair of aligning members to a first distance before the sheet reaches said pair of aligning members if an abnormal condition is detected in said detection step and it is determined that said second sheet process apparatus is not connected in said determination step; and a second aligning member control step for setting a distance between said pair of aligning members to a second distance smaller than said first distance before the sheet reach said pair of aligning members if the abnormal condition is detected in said detection step and it is determined that said second sheet process apparatus is connected in said determination step.

4. A control method for an image forming system including:

an image forming apparatus that forms an image on a sheet;

a first sheet process apparatus having a first moving unit that moves the position of the sheet in a width direction orthogonal to the direction in which the sheet is transported, a first stack unit that stacks the sheet moved in the width direction by said first moving unit and a first aligning unit that aligns the sheet stacked on said first stack unit in the width direction; and a second sheet process apparatus, which is connected to a side further upstream than said first sheet process apparatus, having a second moving unit that receives the sheet ejected from said image forming apparatus and moves the position of the sheet in the width direction orthogonal to the direction in which the sheet is transported, a second stack unit that stacks the sheet moved in the width direction by said second moving unit and a second aligning unit that aligns the sheet stacked on said second stack unit in the width direction; the control method comprising:

a determination step for determining where to stack the sheet ejected from said image forming apparatus;

a detection step for detecting an abnormal condition of said first moving unit; and a sheet movement step for causing said second moving unit to change the position of the sheet in the width direction while the sheet is transported along the second sheet process apparatus if it is determined that the sheet is stacked on the first stack unit and the abnormal condition is detected in said detection step.

5. The control method for the image forming system according to claim 4, further comprising:

an aligning member control step for causing a distance between a pair of aligning members of said first aligning unit to be made greater than a distance between said pair of aligning members in the case where an abnormal condition is not detected in said detection step if the abnormal condition is detected in said detection step.

6. An image forming system capable of transferring a sheet ejected from an image forming apparatus to a plurality of sheet process apparatus, the image forming system comprising:

a first sheet process apparatus that includes a first moving unit that moves the position of the sheet in a width direction orthogonal to the direction in which the sheet is transported and a stack unit on which the sheet processed by said first moving unit is stacked;

a second sheet process apparatus that is connected to the upstream side of said first sheet process apparatus and includes a second moving unit that moves the position of the sheet in a width direction orthogonal to the direction in which the sheet is transported and a detection unit that detects an abnormal condition of said second moving unit; and a control unit that performs control to cause said second moving unit to change the position of the sheet in the width direction and transport the sheet to said first sheet process apparatus if said detection unit detects the abnormal condition in said first moving unit when the sheet ejected from said image forming apparatus is transported to said first sheet process apparatus through said second sheet process apparatus and stacked with the position thereof being changed in the width direction.

7. The image forming system according to claim 6, wherein said first sheet process apparatus includes a pair of aligning units that are provided movably in the width direction and align the sheet with abutting on both sides of the sheet in the width direction and said control unit changes a distance between said pair of aligning units from a first distance to a second distance larger than said first distance before said pair of aligning units align the sheet if said detection unit detects the abnormal condition in said first moving unit and said second moving unit changes the position of the sheet in the width direction.

8. The image forming system according to claim 7, wherein said control unit performs control to increase an interval during which the sheet is ejected from the image forming apparatus in response to the difference between said first distance and said second distance if said detection unit detects the abnormal condition in said first moving unit and said second moving unit changes the position of the sheet in the width direction.

9. An image forming apparatus connected to a first sheet process apparatus having a first moving unit which moves a position of a sheet in a width direction orthogonal to the direction in which the sheet is transported and a second sheet process apparatus which is arranged further upstream than said first sheet process apparatus and has a second moving unit that moves the position of the sheet in the width direction and a stack unit on which the sheet processed by said moving unit is stacked, the image forming apparatus comprising:

an image forming unit for forming an image on a sheet;

a detection unit for detecting an abnormal condition of said first moving unit; and a control unit that instructs said second sheet process apparatus to cause said second moving unit to move the sheet in the width direction if said detection unit detects the abnormal condition when the sheet is transported to said first sheet process apparatus and stacked on said stack unit with the position of the sheet being changed in the width direction.

10. The image forming apparatus according to claim 9, wherein said control unit does not instruct said second sheet process apparatus to cause said second moving unit to move the sheet if said detection unit does not detect the abnormal condition when the sheet is transported to said first sheet process apparatus and stacked on said stack unit with the position of the sheet being changed in the width direction.

* * * * *